US006244586B1

(12) United States Patent
Gauger et al.

(10) Patent No.: US 6,244,586 B1
(45) Date of Patent: Jun. 12, 2001

(54) METHOD AND APPARATUS FOR SEPARATING FLEXIBLE, FLAT OBJECTS

(75) Inventors: Hans-Ernst Gauger, Stuttgart; Hans Ehrlich, Lauffen; Rainer Buschulte, Pleidelsheim, all of (DE)

(73) Assignee: LTG Holding GmbH (DE)

( * ) Notice: Subject to any disclaimer, the term of this patent is extended or adjusted under 35 U.S.C. 154(b) by 0 days.

(21) Appl. No.: 09/189,054

(22) Filed: Nov. 9, 1998

(30) Foreign Application Priority Data

Nov. 8, 1997 (DE) ..... 197 49 498
Jul. 21, 1998 (DE) ..... 198 32 847

(51) Int. Cl.[7] ..... B65H 5/08

(52) U.S. Cl. ..... 271/12; 271/94; 271/96; 271/106

(58) Field of Search ..... 271/12, 94, 96, 271/106, 108

(56) References Cited

U.S. PATENT DOCUMENTS 1,853,781 * 4/1932 Rider ..... 271/12
4,382,593 * 5/1983 Beran et al. ..... 271/12
5,090,676 * 2/1992 Matsuno et al. ..... 271/12
5,478,066 * 12/1995 Yoshida et al. ..... 271/12

FOREIGN PATENT DOCUMENTS 3110970 10/1982 (DE) .
3633601 4/1988 (DE) .
3633602 4/1988 (DE) .
3742637 6/1989 (DE) .
3901907 3/1990 (DE) .
29514909 1/1996 (DE) .
55-156141 * 12/1980 (JP) ..... 271/12
60-106740 6/1985 (JP) .

* cited by examiner

*Primary Examiner*—Janice L. Krizek
(74) *Attorney, Agent, or Firm*—Ostrolenk, Faber, Gerb & Soffen, LLP

(57) ABSTRACT

A method and apparatus for separating flexible flat objects from the top of a stack. The objects are lifted upward from the stack one at a time and separated therefrom by progressive adhesive action starting from the trailing end of the object in a transport direction. Once lifted by the adhesion device, the objects are transported in the transport direction by the transport device. The adhesion device may be magnetic for magnetizable articles or may be a suction device. Various techniques for moving suction and/or adhesion progressively along the object to be lifted in the transport direction are disclosed, including progressive application of suction, suction chamber arrangements for accomplishing that and the use of blown air to create a vacuum condition for lifting the sheets. The transport device might comprise a belt for moving the lifted objects. The transport of one object may be occurring while the next object is being lifted.

24 Claims, 17 Drawing Sheets

Fig. 6A
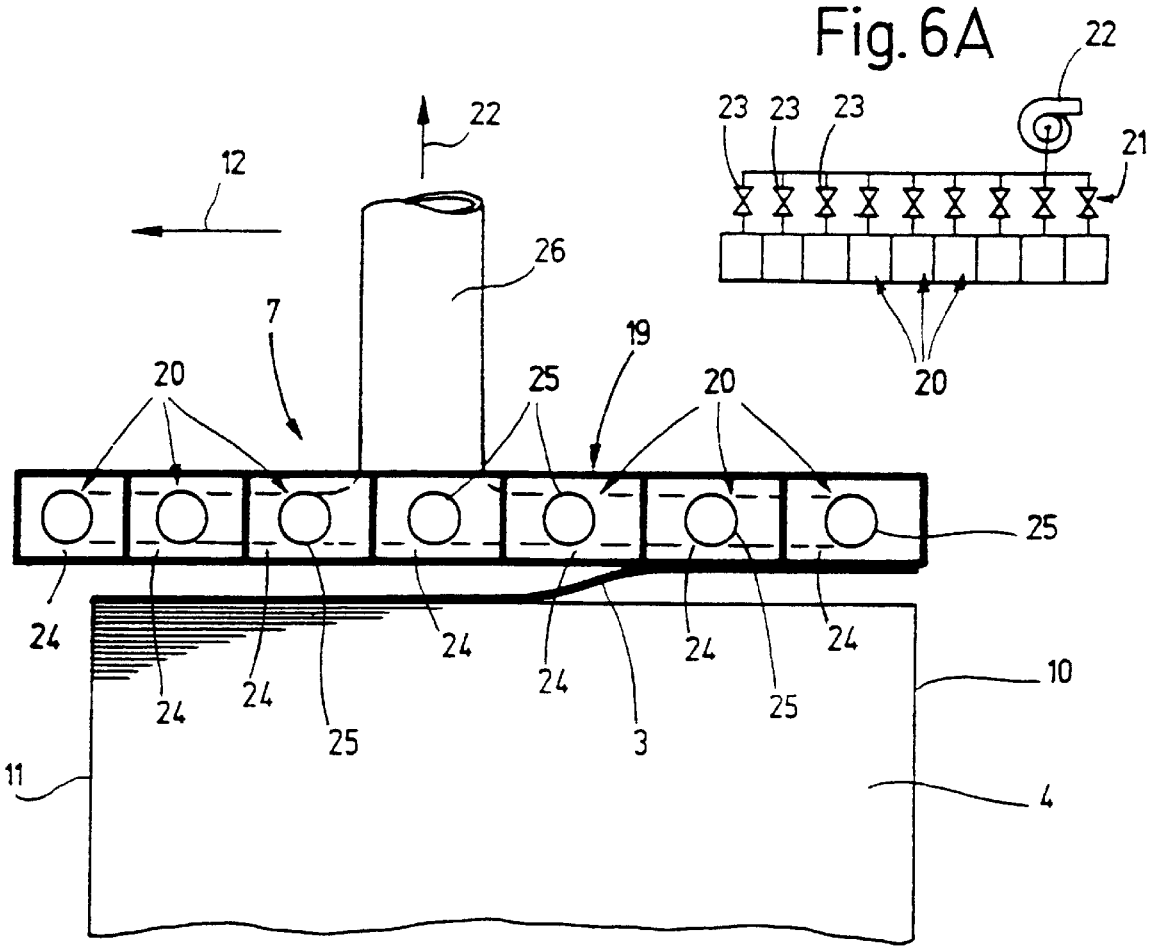
Fig. 6
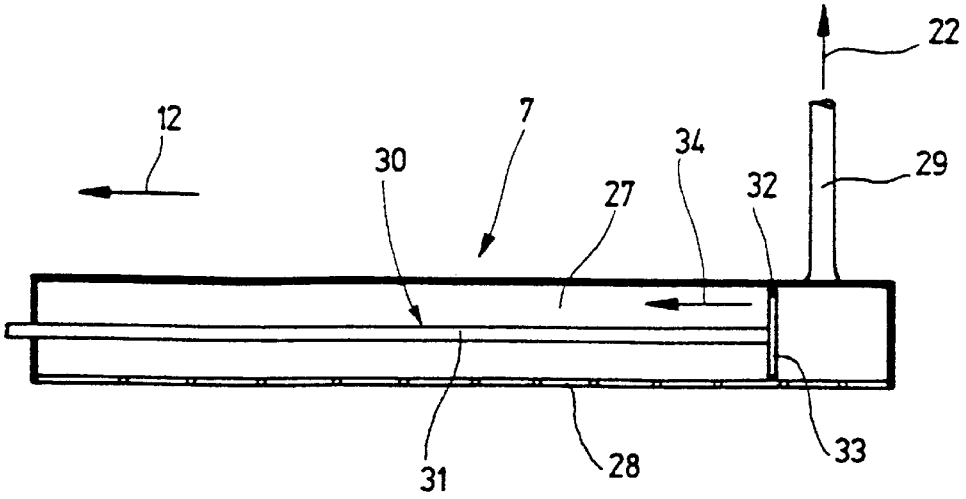
Fig. 7

METHOD AND APPARATUS FOR SEPARATING FLEXIBLE, FLAT OBJECTS

BACKGROUND OF THE INVENTION

The present invention relates to a method for separating flexible, flat objects, especially paper sheets, sheets of board, sheet metal panels, or the like, which objects are lifted upward from a stack and are thereby separated, and are then being transported away in a transport direction that runs horizontally or at least approximately horizontally.

It is known to lift flexible, flat objects, for example sheet metal panels, from a stack by means of a vacuum device applied over the entire area, and then to transport the objects horizontally in the transport direction, in order to feed them to further-processing. The number of objects lifted and transported per unit time may not be increased indefinitely, because at increasing speed, the risk that a number of objects will be lifted at the same time increases, when the following sheet metal panel adheres to the lifted object like a sheet metal panel, that is located at the top. In spite of remedial measures, for example lateral introduction of blown air in order to improve the process of separating the panels, multiple lifting cannot be avoided at very high speeds. In addition, in modern feeders which act on the leading edge, the lifting sucker has to be put down on the stack during the panel gap between two successive panels and has to attract the next panel by suction and lift it. In the process, at high speeds, the time available becomes too short to permit trouble-free and low-vibration transport.

SUMMARY OF THE INVENTION

An object of the invention is to provide a method for separating flexible, flat objects and which ensures free operation even with large numbers of objects per unit time.

According to the invention, for the purpose of lifting, an adhesive action is built up which progresses in the transport direction and attracts the object. Consequently, the flat object is not lifted over its entire surface area or its entire length but is lifted progressively, region by region, specifically in such a way that the adhesive action which effects the lifting progresses in the transport direction. The trailing edge of the flat object is lifted first. During further lifting, the regions of the object progressively forward of the trailing edge are lifted by the adhesive action that builds up progressively, until the leading edge is reached. During the lifting, the progressive adhesive action subjects the object to reversible, for example S-shaped, bending, so that as viewed in cross section, it is transferred into the lifted position in the form of a "wave" that runs from the trailing edge to the leading edge. Once the lifted position has been reached, the object is transported away in a transport direction that runs horizontally or approximately horizontally.

After one article has been transported away, the following article is lifted from the stack. However, lifting of the following article may also take place in a position while it is overlapping the previous article, that is, as soon as the previously lifted article has been transported away, even by a small amount, and even though there is still a partial overlap of the first article with the stack, the following article is lifted starting in the region of its trailing edge. Lifting therefore takes place in a region of each article, e.g. a panel, which has been exposed by the previously lifted panel being transported away. The progressive lifting of each following panel is coordinated with the transporting away of the previously lifted panel.

In a development of the invention, the adhesive action is provided as a vacuum action. Applied vacuum can lift flexible, flat objects made of any material. If the objects are ferromagnetic, it is also possible to achieve the adhesive action by a magnetic holding action. The disclosure herein essentially discusses vacuum action. However, this disclosure also applies to magnetic devices.

The invention further relates to an apparatus for separating flexible, flat objects, in particular paper sheets, sheets of board, sheet metal panels, or the like. The apparatus includes an adhesion device which lifts the objects upward from a stack, and a transport device that transports the lifted objects in a transport direction that runs horizontally or at least approximately horizontally. The adhesive action that attracts each object is built up progressively in the transport direction. Accordingly, first the trailing edge of the object is lifted from the stack by adhesive action in the region of the trailing edge of the object. Then the remaining regions of the object are lifted, progressively in the transport direction, on account of the adhesive action, of the adhesion device, which progresses in the transport direction.

In a preferred embodiment, the adhesion device has a plurality of suction elements, which are located beside one another in the transport direction and can be activated and deactivated one after another. Activation of a suction element lifts the associated region of the sheet metal, or the like, panel into the lifted position. If the suction action is powerful enough and/or the suction element is at a sufficiently short distance from the sheet metal panel, the lifting occurs via the suction action. Alternatively, however, a lifting device may lift the sheet metal panel to a higher level in the region of its trailing edge so that the suction elements can develop their action and hold the panel in this region. This lifting device may, for example, be a pneumatic device, that is a piston which has a suction device at its free end and is moved up and down pneumatically.

In a further embodiment, the adhesion device has at least one suction means, which extends in the transport direction and can be activated progressively, or deactivated in the opposite direction, by displacing a slider. The slider, for example, enables suction openings to be opened, or enables a suction chamber in the adhesion device to be enlarged or reduced in size. An essentially downwardly open suction chamber has a side wall that is formed by the slider. When the object is being lifted, the side wall is displaced in the transport direction, so that the suction chamber expands in the transport direction. The progressive attraction of the object by suction takes place on account of the concomitantly progressive expansion of the suction chamber.

In a further preferred embodiment, the adhesion device is displaced continuously or segment by segment in the transport direction and in the direction of the object for the purpose of lifting it. Consequently, the adhesion device is first lowered in the region of the trailing edge of the object, so that the adhesive action starts there, and the corresponding region of the article is lifted. The adjacent regions of the adhesion device are then displaced continuously or segment by segment in the direction of the object, so that these regions of the object are also gripped and lifted.

In particular, after lifting of one region of the object, the adhesion device moves away from the stack again in this region. Consequently, the corresponding region of the adhesion device returns to its initial position as soon as the article has been lifted in this region.

In another embodiment, the adhesion device has at least one suction means, which extends in the transport direction and has a suction chamber which can be divided by at least one dividing wall into part chambers. The dividing walls or regions thereof can be displaced in order to connect/isolate adjacent part chambers. Firstly, the suction chamber is subdivided into part chambers by the dividing walls. The part chambers that are assigned to the trailing edge of the sheet metal panel have vacuum applied to them. As a result, the flexible, flat object is lifted in this zone. The dividing walls are then progressively displaced, so that the part chambers communicate with one another, that is, the part chambers are connected together progressively as far as the leading edge of the sheet metal panel. They are gradually all supplied with vacuum. Because of this, they develop their adhesive action, so that the article is progressively and continuously lifted.

Moreover, it is advantageous if the adhesion device has a plurality of suction chambers/suction openings, which are located beside one another in the transport direction and which can be activated/deactivated one after another by a vacuum control device. The activation or deactivation can be carried out, for example, by a valve control system, which is located between a vacuum source and the suction chambers or suction openings.

It is advantageous for the adhesion device to have at least two suction belt sections, which are located adjacent to one another in the transport direction and which at the same time form the transport device. It is possible for the vacuum and drive of suction belt sections to be activated/deactivated one after another or simultaneously. By successively activating the vacuum, it is possible to develop the adhesive action and to lift the object progressively and then to transport the object away horizontally by means of the simultaneous activation of all the drives of the suction belt sections. Once the trailing edge of a sheet metal panel leaves a suction belt section, the section can be deactivated again. The deactivation takes place with regard to the drive, so that, to create an interleaved system of sheet metal panels, the following sheet metal panel can be lifted in the region of its trailing edge. The individual suction belt sections thus have lengths which are shorter than the longitudinal format (i.e., format as viewed in the transport direction) of the sheet metal panels.

It is advantageous if suction elements, which can preferably be activated/deactivated under control, are located between adjacent suction belt sections. It is also possible for these suction elements then to be used for the progressive lifting of the sheet metal panels.

According to a further embodiment, the adhesion device is a blown air device, which blows air essentially along the surface of the object to be lifted. Blowing air approximately parallel to the surface of the sheet metal panel produces a suction effect which lifts the sheet metal panel to a higher level. This action also takes place progressively, starting from the trailing edge and going as far as the leading edge.

In a preferred embodiment, the adhesion device is a vacuum device, having a blown air device such that the blown air at least partly cancels the vacuum action of the adhesion device. Therefore, if the vacuum device is supplied with blown air in a specific region, then the vacuum develops no effect there, and no lifting of a sheet metal panel occurs in this region. By controlling the blown air, i.e., it is possible to influence the intensity and/or the direction and/or the point of incidence of the blown air. The vacuum action, which is constant over the entire length of the sheet metal panel, is specifically influenced in such a way that it builds up progressively in the transport direction, so that the object is correspondingly progressively lifted.

Once the object has been lifted to a higher level over its entire length and area by the adhesion device, then it is transported away horizontally by means of a transport device, which preferably has controlled-drive and preferably controlled-vacuum suction belts.

Other objects and features of the invention are seen in the drawings.

BRIEF DESCRIPTION OF THE DRAWINGS

FIG. 6 shows schematically a part of a second embodiment of a separating apparatus, FIG. 6A schematically depicts elements of the second embodiment, FIG. 7 shows schematically a part of a third embodiment of a separating apparatus.

DESCRIPTION OF PREFERRED EMBODIMENTS

Figure 1:
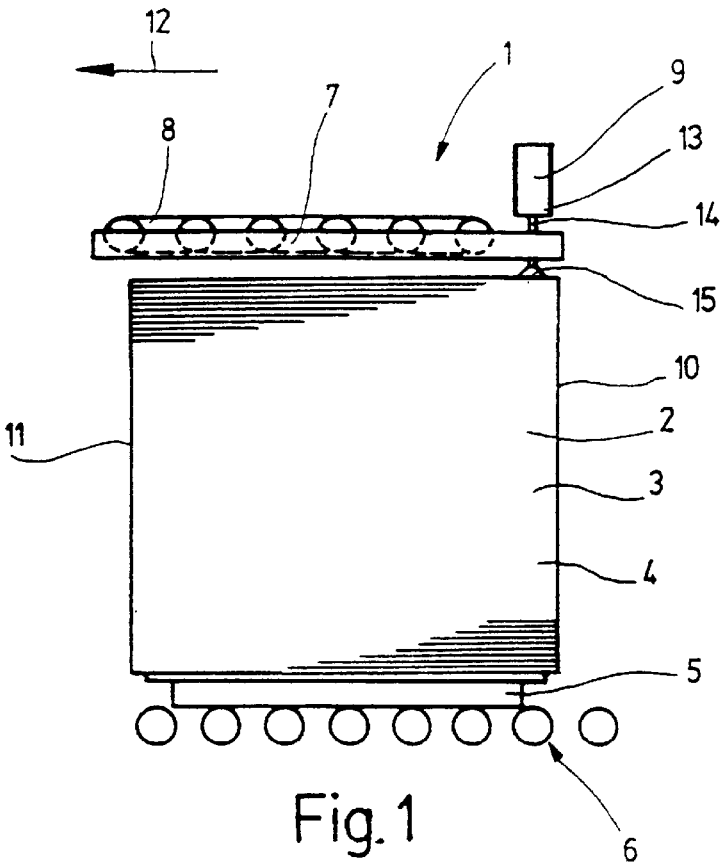
FIG. 1 shows a schematic side view of an apparatus for separating flexible, flat objects with the apparatus in a first operating state.
Figure 2:
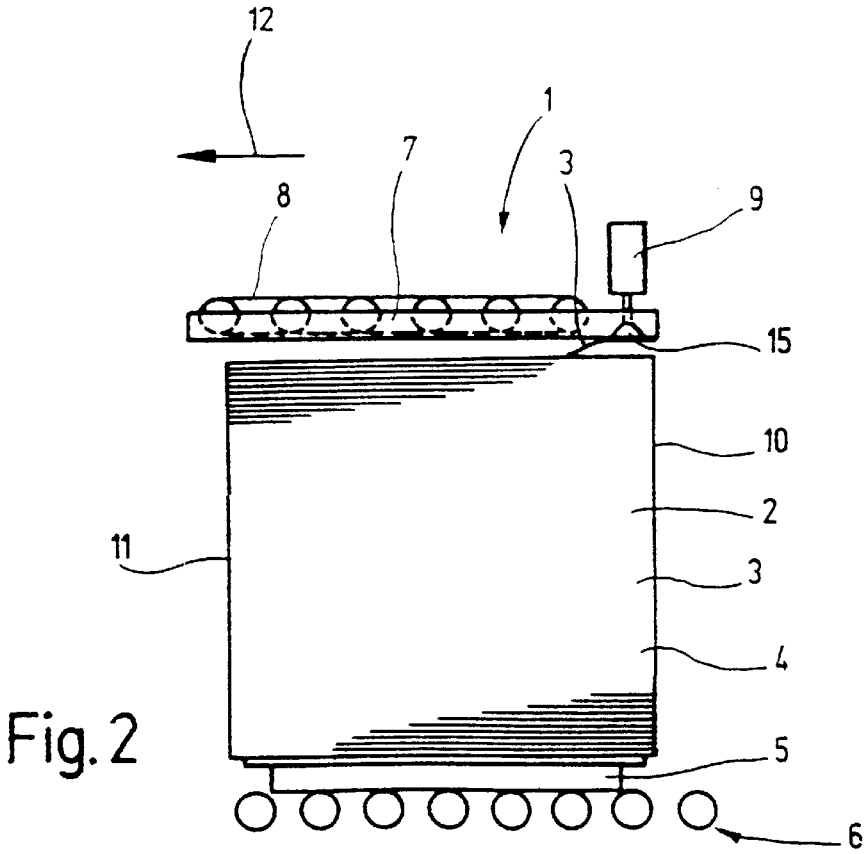
FIG. 2 shows the apparatus of FIG. 1 in a second operating state.
Figure 3:
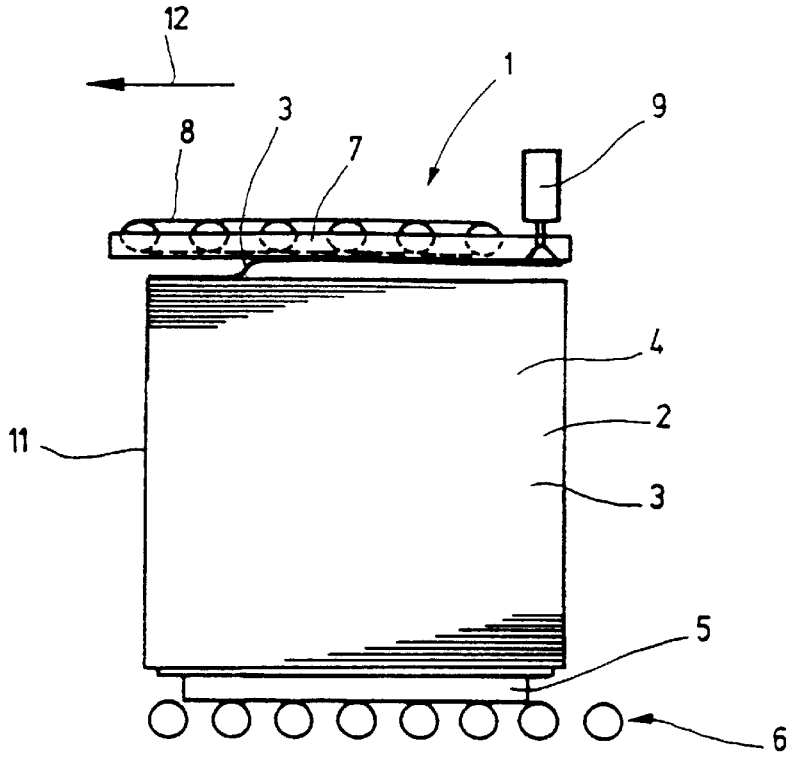
FIG. 3 shows the apparatus of FIGS. 1 and 2 in a third operating state.
Figure 4:
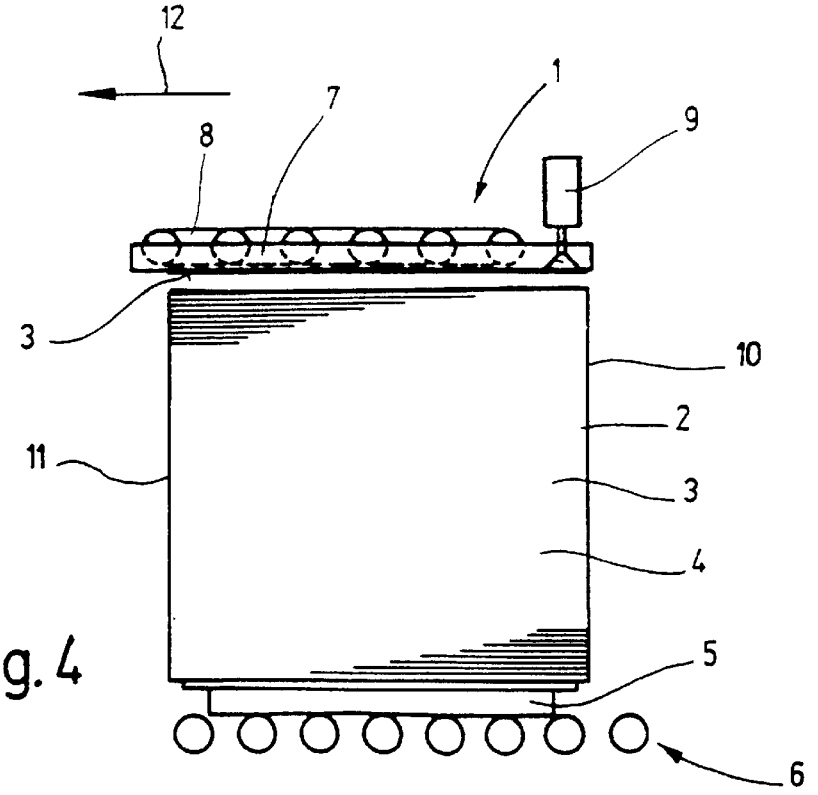
FIG. 4 shows the apparatus of FIGS. 1 to 3 in a fourth operating state.

FIG. 1 schematically shows a first apparatus 1 for separating flexible, flat objects 2, which may be sheet metal panels 3. The sheet metal panels 3 are arranged lying one above another in a stack 4, and their planes run horizontally. For delivering the stack 4, it is advantageous if it is located on a pallet 5, which can be moved, for example by a roller track 6, into a suitably aligned position in relation to the apparatus 1.

The apparatus 1 includes an adhesion device 7, a transport device 8 and a lifting device 9. Each sheet metal panel 3 has a trailing edge 10 and a leading edge 11. The leading edge 11 points in the transport direction (arrow 12). The uppermost sheet metal panel 3 of the stack 4 is spaced a vertical distance below the adhesion device 7 and the transport device 8. While the stack 4 is being processed, this spacing is maintained approximately. As the height of the stack 4 is reduced, a lifting device (not illustrated) lifts the remainder of the stack to maintain that spacing from the adhesion device 7 and/or transport device 8 within a specific range.

The panel initial lifting device 9 comprises a panel lifting sucker 13, including a piston rod 14, which can be moved up and down pneumatically by a control device (not illustrated) and which has a controllable suction head 15 at its free bottom end.

The following explanations of the adhesion device 7, the transport device 8 and the lifting device 9 in each case relate to the exemplary embodiments illustrated. No reference is made to the width or the format of the sheets or sheet metal panels 3. However, if these sheets or sheet metal panels 3 have a not inconsiderable width, which can be assumed, then a plurality of elements of the adhesion device 7, of the transport device 8 and also of the lifting device 9 are distributed over the width of the panels, in order to grip the entire width of each panel and to ensure that the sheet metal panels 3 are lifted and transported away in a fault-free manner.

First, the various operating positions of FIGS. 1 to 5 are discussed to explain the functioning of the apparatus 1. Then various exemplary embodiments of the apparatus 1 are disclosed.

In FIG. 1, the stack 4 is located beneath the apparatus 1. In order to lift the uppermost sheet metal panel and to hold it in the lifted position, the piston rod 14 of the lifting sucker 13 is lowered, in the region of the trailing edge 10 of the panel, onto the upper side of the then top sheet metal panel 3. The controllable suction head 15 is activated to develop suction. According to FIG. 2, the piston rod 14 is then retracted. This lifts the sheet metal panel 3 in the region of its trailing edge 10, bringing its upper side against the underside of the adhesion device 7. As a result of the lifting operation, elastic reshaping of the sheet metal panel 3 takes place, that is, part of it is located at the height of the adhesion device 7, and another part is still at the height of the uppermost stack level. The region between them assumes an S-shaped bend. This bending is reversible, as the elastic limit of the sheet metal panel 3 is not exceeded, so that no permanent deformation occurs. According to FIG. 3, further lifting by the adhesion device 7 develops an adhesive action which, starting from the trailing edge 10, progresses in the direction toward the leading edge 11. This progress may occur continuously or segment by segment. However, it is always ensured that, for example as a result of vacuum being built up on the adhesion device 7 progressively in the transport direction 12, that a progressive adhesive action is developed. The sheet metal panel 3 is lifted to the level of the adhesion device 7 as a result of the suction action. If the adhesion device is not a vacuum device but, for example, is instead a magnetic arrangement, then it is also possible to lift ferromagnetic sheet metal panels in a corresponding manner. During the progressive lifting, the S shape travels in the direction toward the leading edge 11, until the entire sheet metal panel 3 has been lifted as in FIG. 4. It is then located in an aligned position above the stack 4, held by the adhesion device 7.

Figure 5:
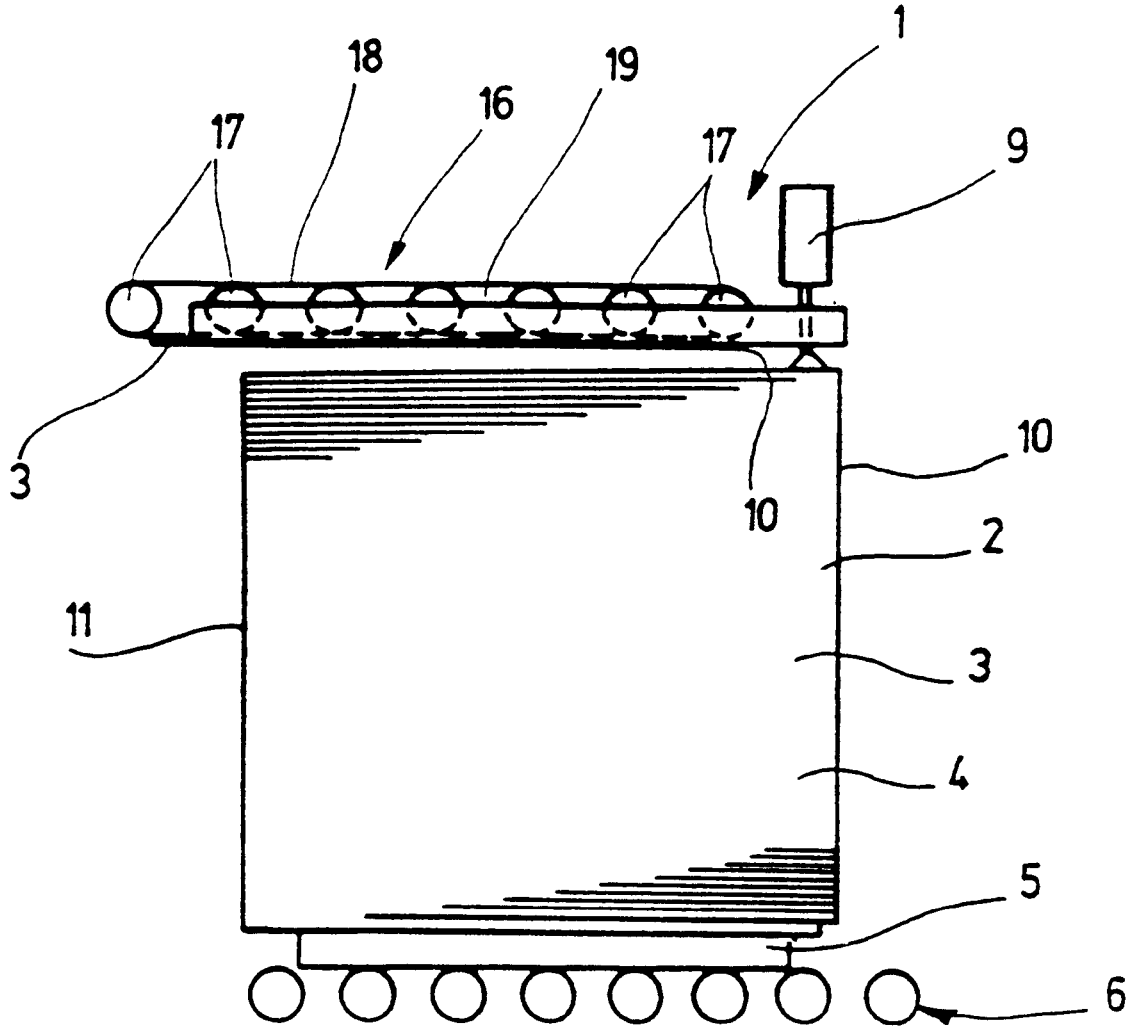
FIG. 5 shows the apparatus of FIGS. 1 to 4 in a fifth operating state.

After a sheet metal panel 3 has been lifted completely (FIG. 4), then the transport device 8 begins functioning. In the embodiment of FIGS. 1 to 5, that device is a controlled-drive and controlled-vacuum suction belt device 16, including a plurality of rollers 17 over which at least one endless suction belt 18 runs. There is at least one vacuum box 19 inside the loop of the suction belt 18. To carry the sheet metal panel 3 lifted by the adhesion device 7 away horizontally, the drive of the transport device 8 is activated, and the sheet metal panel 3 is taken over by the transport device 8 from the adhesion device 7 and is transported away in the transport direction 12, for example it is fed to a further-processing station. In FIGS. 1 to 5, the transport device 8 is illustrated as a relatively short unit. In practice, it may have a significantly greater length, or it is possible for a number of transport devices 8 to be connected in series, one behind the other. In this way, the lifted sheet metal panel 3 is transported away, as illustrated in FIG. 5.

In FIG. 5, the trailing edge 10 of the lifted sheet metal panel 3 has already moved sufficiently far away from the trailing edges 10 of the sheet metal panels 3 remaining on the stack 4 that the lifting sucker 13 can act again to lift the trailing edge of the next sheet metal panel 3 from the stack 4. The adhesion device 7 then applies an appropriately controlled progressive adhesion action, such that the transfer of the corresponding region of the following sheet metal part 3 takes place without it colliding with the trailing edge 10 of the previously lifted sheet metal panel 3 that is still moving away. Consequently, the lifting and transporting steps can occur with the sheet metal panels 3 in an overlapping position, enabling a very large number of panels to be moved per unit time.

FIGS. 6 and 6A show an exemplary embodiment of an adhesion device 7. (For reasons of simplicity, the transport device 8 of the apparatus 1 is not illustrated.) The adhesion device 7 includes a plurality of suction elements 20, which are located beside one another in the transport direction (arrow 12), can be activated/deactivated one after another, and are connected via a vacuum control device 21 to a vacuum source 22. The design is illustrated schematically in FIG. 6A. It can be seen that the vacuum control device 21 comprises a large number of valves 23, which are located between the vacuum source 22 and each respective suction element 20. The suction elements 20 comprises chambers open at their bottoms 24, and which are connected, via pipe connectors 25 and via the valves 23 connected to the pipe connectors 25, via a common suction line 26 to the vacuum source 22. The vacuum control device 21 activates the valves 23 one after another in such a way that, in order to lift the sheet metal panel 3 located at the top of the stack 4, that panel is first lifted in the region of its trailing edge 10 and then progressively, segment by segment, by activating the respectively adjacent chamber 24. In this embodiment, no lifting device 9 is illustrated. This showing applies generally to all the embodiments of the invention, which may either have a lifting device 9 or may have no lifting device 9. If no lifting device 9 is provided, then the adhesive action of the adhesion device 7 is sufficient to overcome the spacing away from the panel 3 located at the top of the stack, so that the lifting of the panel 3 takes place automatically as a result of the adhesion device being activated.

FIG. 7 illustrates a further embodiment of an adhesion device 7, which like all the other adhesion devices 7 of the various embodiments, is preferably designed as one or more suction bars. FIG. 7 shows a suction chamber 27 that extends in the transport direction (arrow 12) and is open at the bottom, where there is only an air grill 28. In the region where the trailing edge 10 of the sheet metal panels 3 (not illustrated in FIG. 7) would be located underneath the adhesion device 7, a suction line 29 opens into the suction chamber 27. The air line 29 is connected to a vacuum source 22. A slider 30 is mounted in the suction chamber 27 so as to be displaceable horizontally in the transport direction 12. The slider 30 has a piston rod 31 and a piston wall 32, which forms a displaceable suction chamber wall 33. When the suction chamber wall 33 is displaced in the direction of the arrow 34 by the piston rod 31, then the active volume of the suction chamber 27 is enlarged, so that the adhesive action (suction action) is built up progressively in the transport direction 12. A sheet metal panel 3, attracted by suction, is lifted in synchronism with the movement of the slider 30 and is held on the adhesion device 7. Then the sheet metal panel 3 is transported by the transport device 8 (not illustrated).

Figure 8:
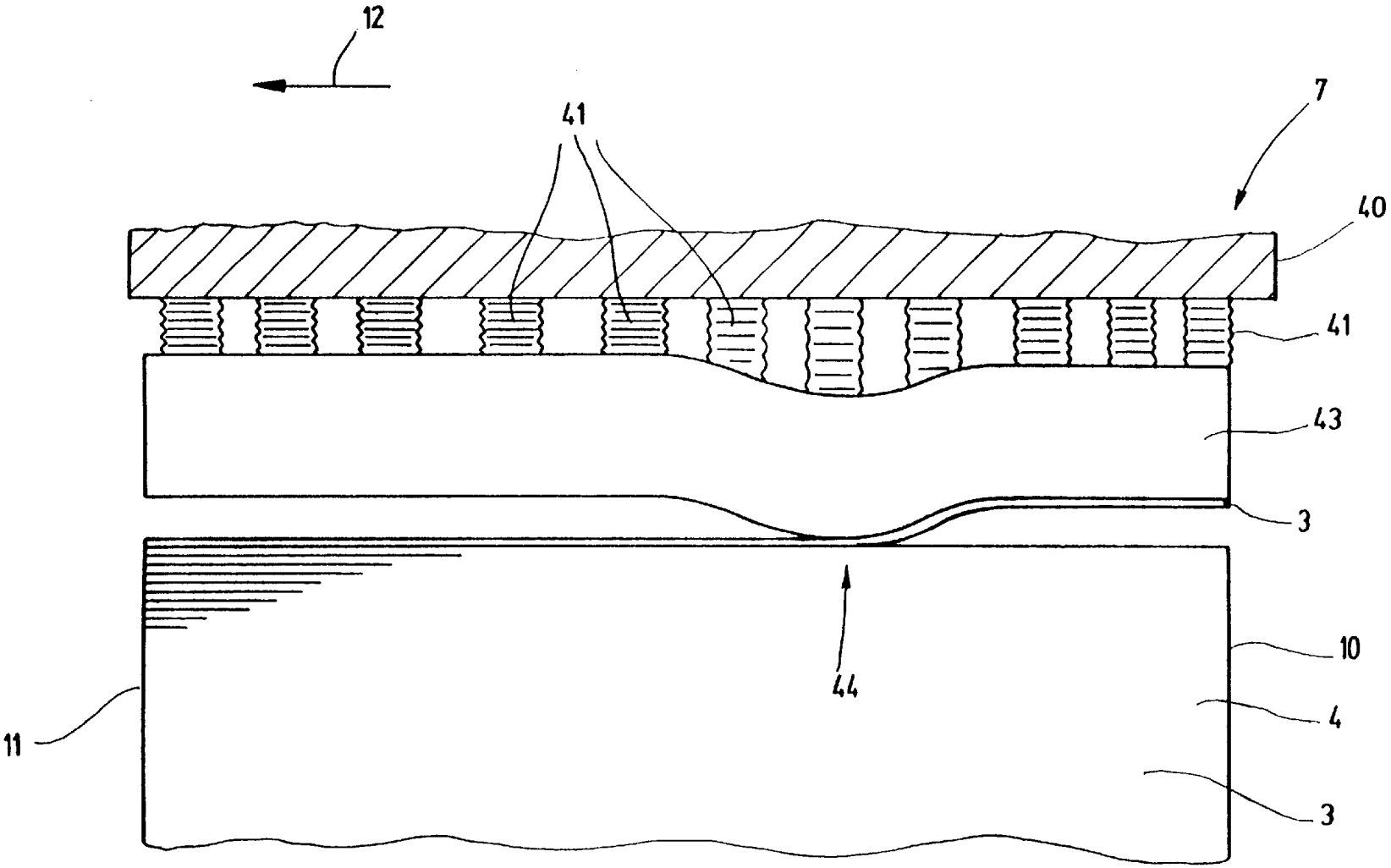
FIG. 8 shows schematically a part of a fourth embodiment of a separating apparatus.

FIG. 8 shows an embodiment of an adhesion device 7 which has a stationary plane 40 above the stack 4. Air cushions 41 originate from the stack, to which a suction bar 43 is fastened. Consequently, the suction bar 43 hangs above the stack 4 via the air cushions 41 on the plane 40. The suction bar 43 is connected to a vacuum source (not shown). The bar 43 is flexible over its length, that is in the transport direction 12, so that it can be deformed in the direction of the stack 4 with the effect of a "continuous wave." The suction bar 43 is open at the bottom, so that a sheet metal panel 3 can be attracted by suction. Because of the large number of air cushions 41 arranged over the length of the sheet metal panel 3, it is preferably possible for the air cushions to be designed as accordion pleated hoses, it is possible for the suction bar 43 to move toward the upper side of the stack 4. This is done by appropriate activation of the air cushions 41, which sets their lengths individually. A corresponding pneumatic control device (not shown) activates the various air cushions to operate in such a way that the suction bar 43 is first lowered in the region of the trailing edge 10 of the sheet metal panels 3. As a result, the top sheet metal panel 3 is attracted by suction and lifted. Following the attraction by suction, the associated air cushion 41 returns to its original retracted position, producing a gap between the lifted region of the sheet metal panel 3 and the following sheet metal panel 3 that is still located on the stack 4. Through further lifting of the sheet metal panels 3, the air cushions 41 are activated continuously in the transport direction 12 so that they deform the suction bar 43 to produce a generally curved region of the bar which runs as far as the leading edge 11 of the sheet metal panels 3 on the stack 4. This develops a continuously progressive adhesive action which lifts the sheet metal panels 3. The panels are transported away using a transport device 8 (not shown). In FIG. 8, the continuously curved region, running in the transport direction 12, of the suction bar 43 is identified by the arrow 44.

Figure 9:
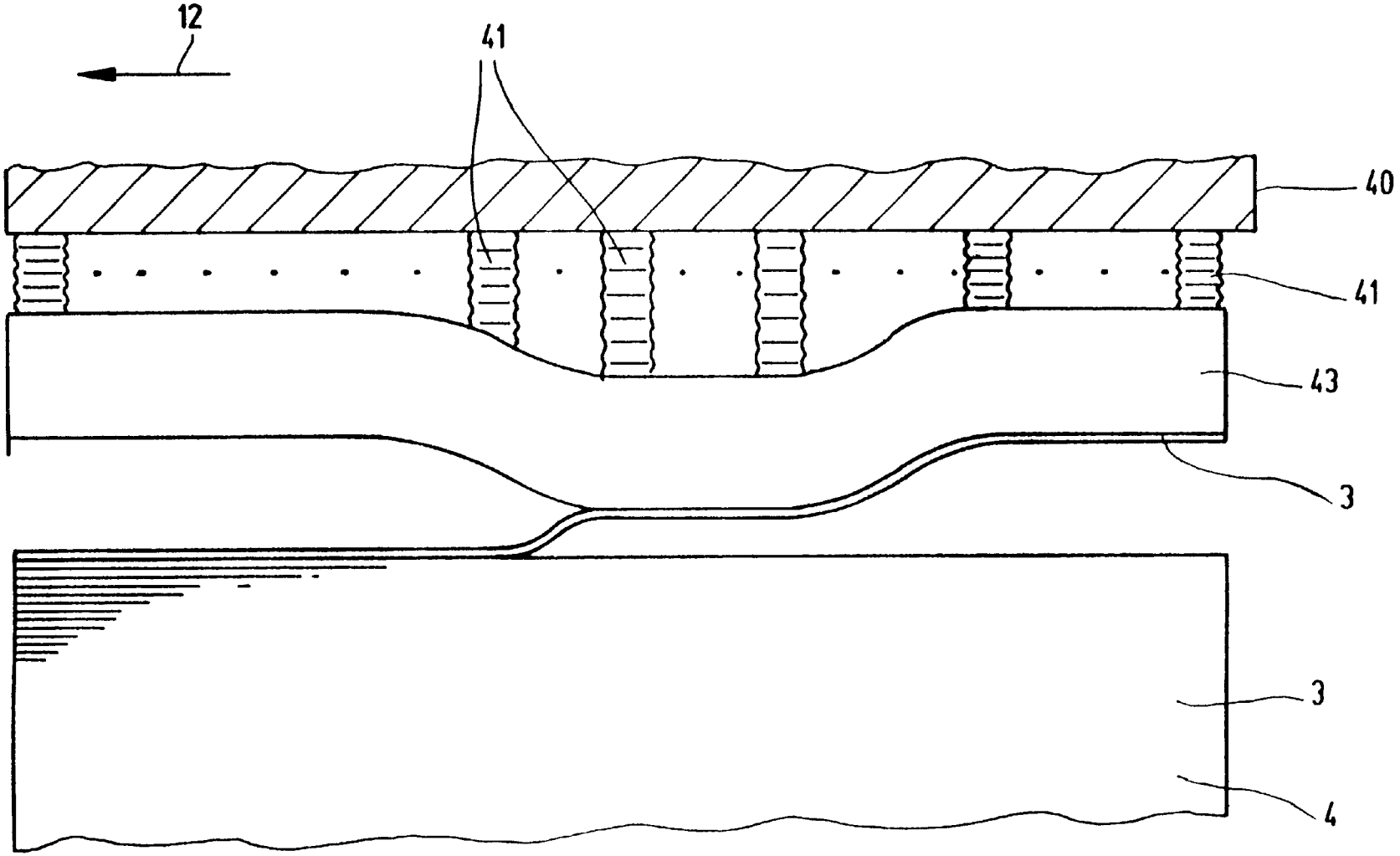
FIG. 9 shows schematically a part of a fifth embodiment of a separating apparatus.

The embodiment of FIG. 9 corresponds to the embodiment of FIG. 8, but without continuous activation of the air cushions 41. Instead activation proceeds segment by segment in the transport direction 12, with the air cushions 41 essentially assuming only two states, the normal shortened state and the elongated activated state (long length). The suction bar 43 is lowered not with continuous bending which moves in the transport direction, but rather discontinuity. Otherwise, however, the operation of the embodiment of FIG. 9 is the same as the embodiment of FIG. 8. However, the difference is that in FIG. 9, the suction bar 43 is not placed onto the stack 4, as in FIG. 8.

Figure 10:
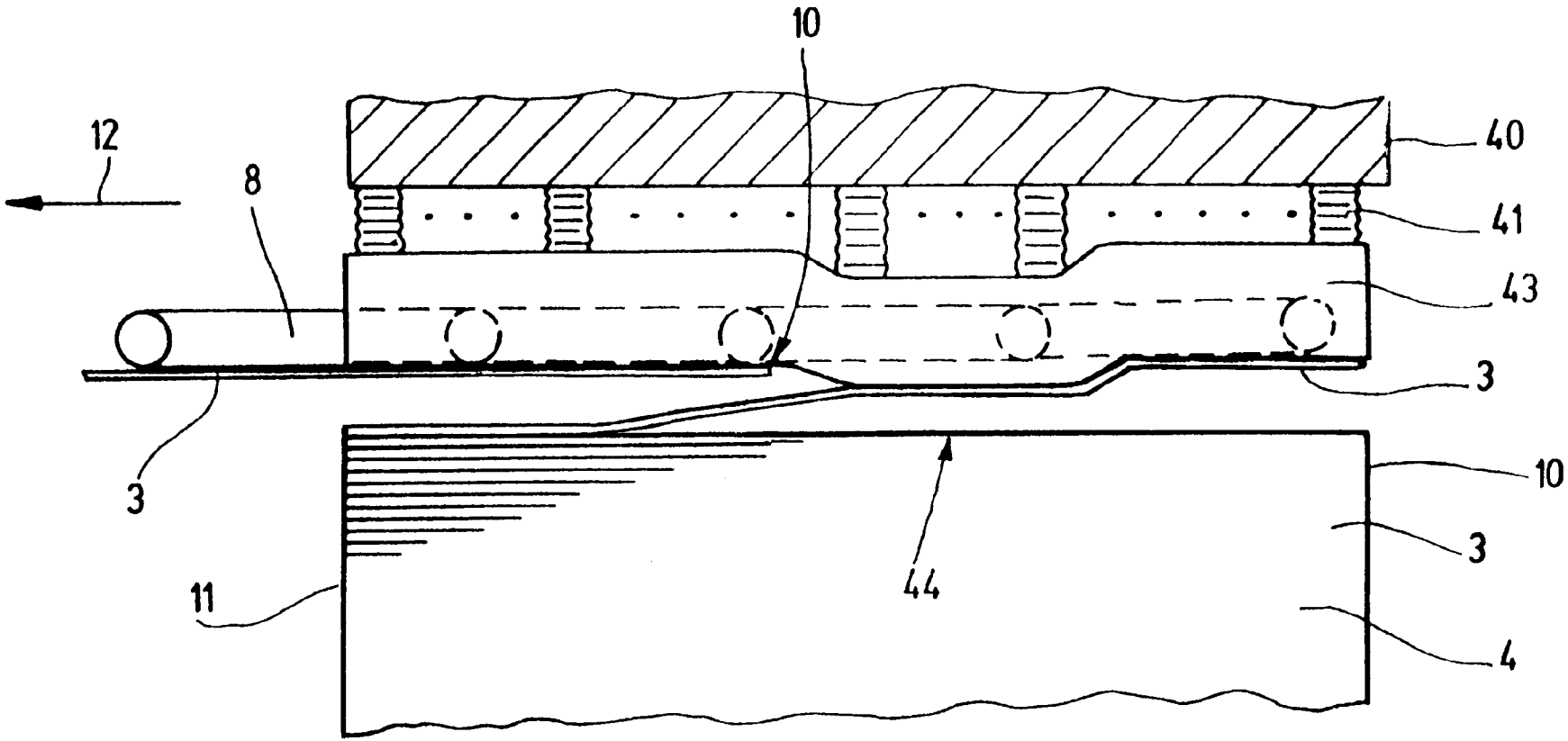
FIG. 10 shows schematically a further illustration of the fifth embodiment of FIG. 9.

The embodiment of FIG. 10 illustrates the functioning of the exemplary embodiment of FIG. 9 when a sheet metal panel 3 and a following sheet metal panel 3 overlap. A first sheet metal panel 3 has already been lifted and has been transported away by the transport device 8 in the transport direction 12. The trailing edge 10 of the sheet metal panel 3 that is being transported away is located approximately at the center of the longitudinal format of the stack 4. The region of the flexible suction bar 43 that is located to the right, on the trailing edge 10 of the sheet metal panel 3 that is being transported away, is again available to lower the suction bar in the direction of the stack 4 by the expandable air cushions 41 in the region of the trailing edge 10, and to bring about an adhesive action, progressing in the transport direction 12, on account of appropriately continuously occurring suction bar deformation. As a result, in the overlapped position in relation to the sheet metal panel 3 being transported away, a new sheet metal panel 3 can be lifted from the stack 4, without the two sheet metal panels 3 colliding.

Figure 11:
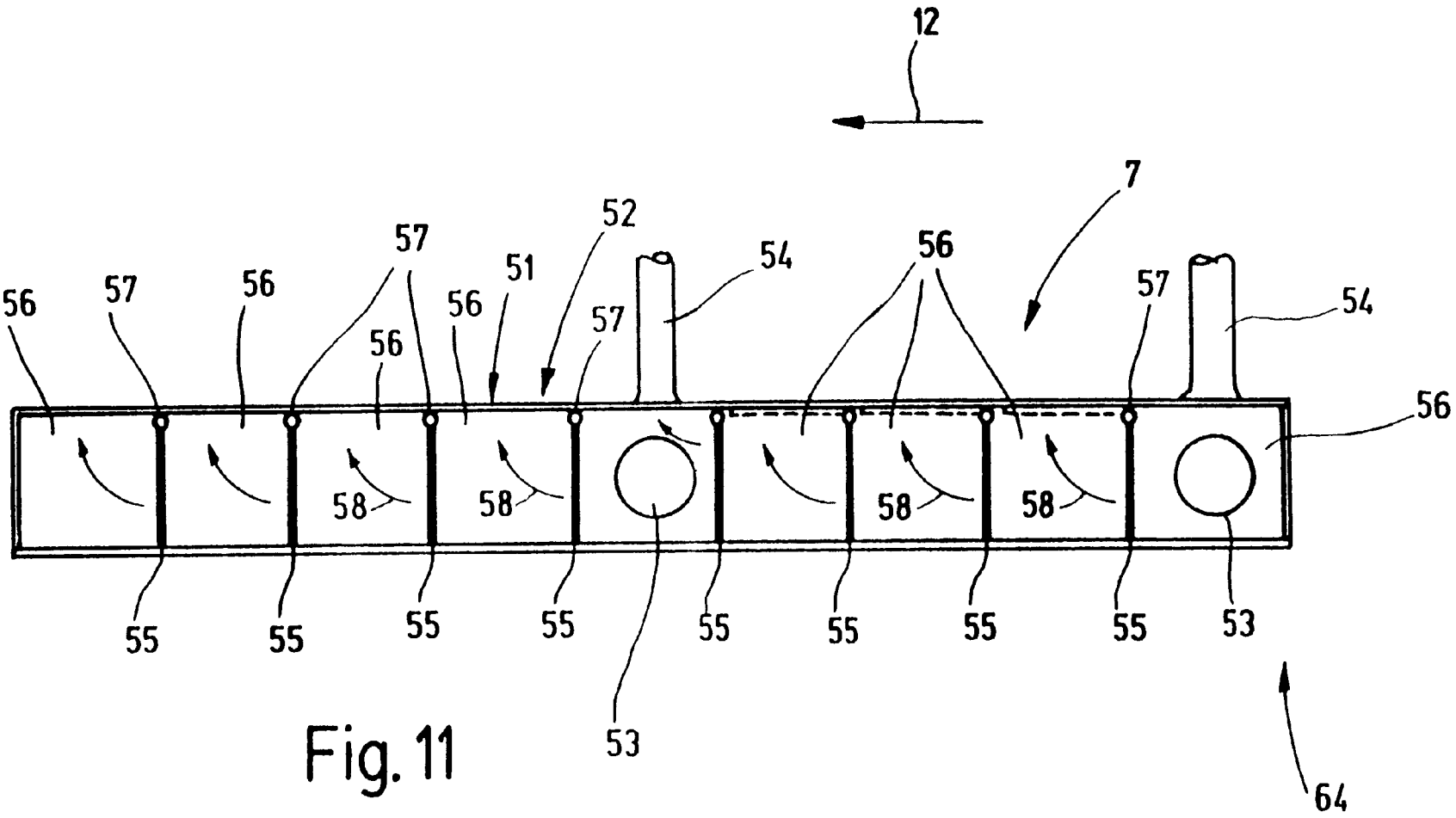
FIG. 11 shows schematically a part of a sixth embodiment of a separating apparatus.

FIG. 11 shows an embodiment of an adhesion device 7, which has a suction means 51 which extends in the transport direction 12 and is designed as a suction chamber 52. The suction chamber 52 is open at the bottom, toward the stack 4 and is connected via a number of air suction connectors 53 and suction lines 54 to a vacuum source (not shown). Dividing walls 55 are arranged inside the suction chambers 53 extending transversely to the transport direction 12, so that the suction chamber 52 is divided into a large number of part chambers 56. In their upper region, the dividing walls 55 can be pivoted in the direction of the arrow 58 around pivot shafts 57, enabling variation of the volume of the suction chambers 52. For instance, two dividing walls 55 are illustrated with dashed lines, showing the folded positions. The vacuum source (not shown) is connected by a suction connector 53 to the part chamber 56 that is located to the right, so that when the vacuum is activated, adhesive action is developed in the region of the trailing edge 10 of a panel. As the individual dividing walls 55 are tilted or pivoted one after the other, as viewed in the transport direction 12, the vacuum action moves in the direction of the transport device 12, which builds up the adhesive action progressively in the transport direction 12. In the embodiment of FIG. 11, and also in the other embodiments, a plurality of suction connectors 53 are often distributed over the length of the adhesion device 7. Following the opening of the chamber separating means, that is following the tilting of an appropriate dividing wall 55, this makes it possible to close the preceding chamber separating means again by moving the dividing walls there again into the vertical position causing pressure relief there to not develop any adhesive action, for example, approximately at the center of the longitudinal format of a sheet metal panel 3, for interleaved separation of the sheet metal panels 3. This is because the adhesive action is intended to begin, at the earliest, in the region of the trailing edge 10 or at a specific distance downstream of the trailing edge 10.

Figure 13:
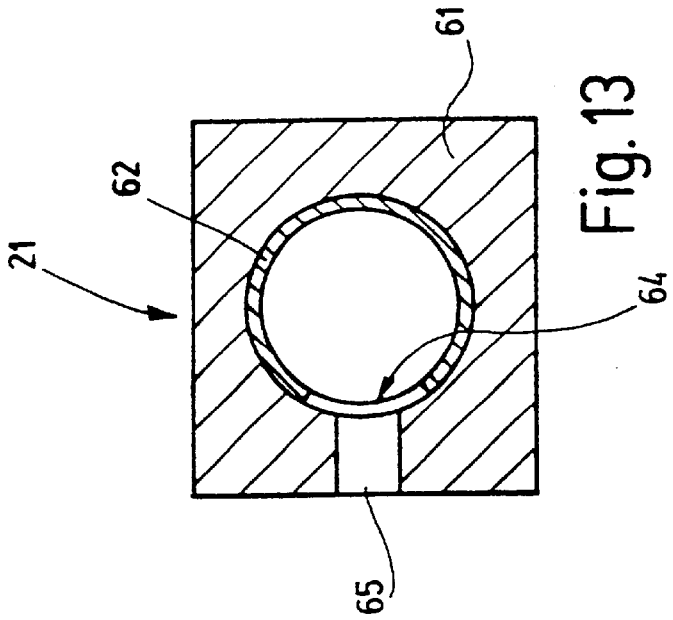
FIG. 13 shows a cross-section through a first vacuum control device for the seventh embodiment of FIG. 12.
Figure 12:
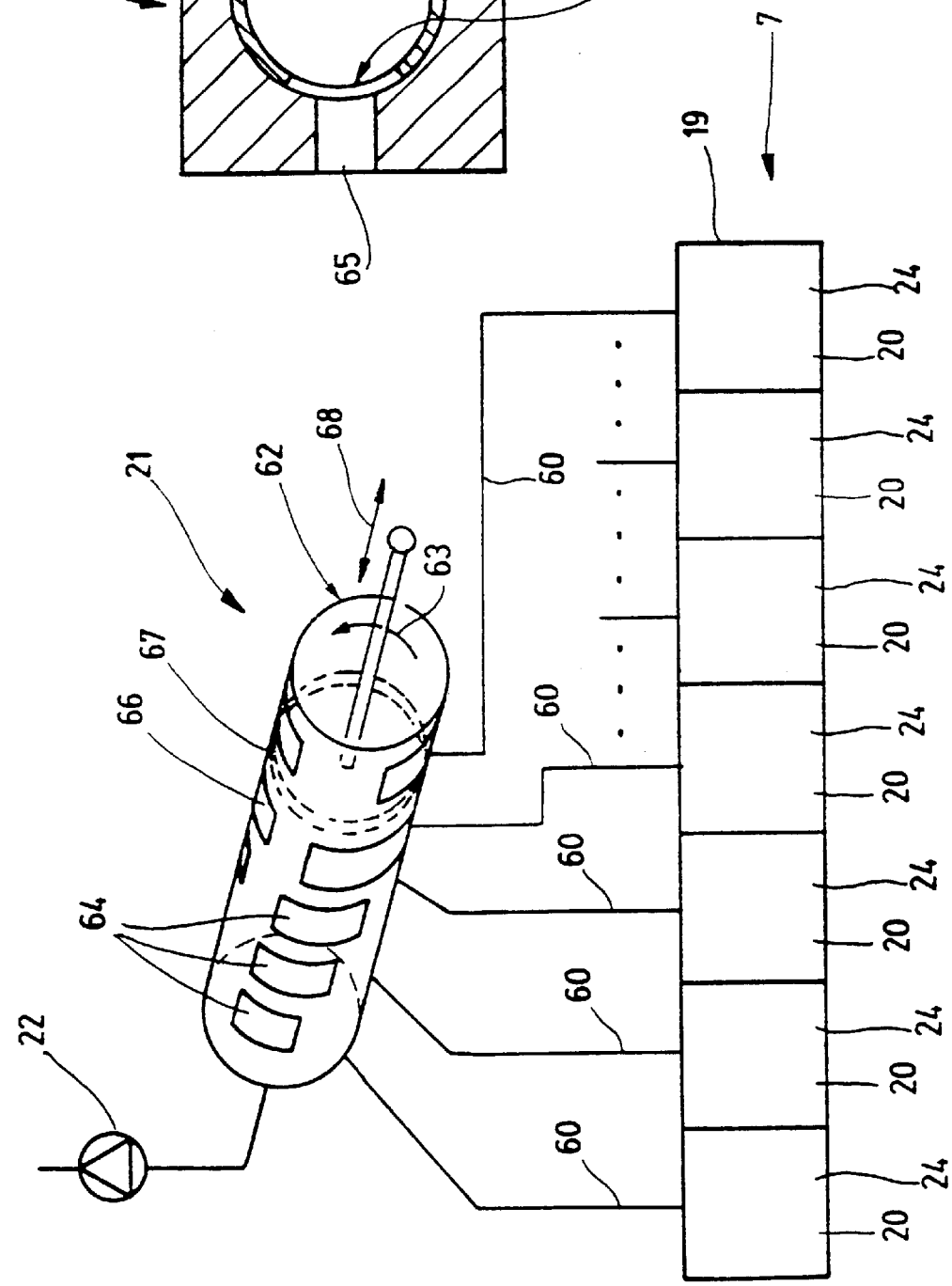
FIG. 12 shows schematically a part of a seventh embodiment of a separating apparatus.

FIGS. 12 and 13 show an embodiment of an adhesion device 7, which corresponds in construction to the vacuum box 19 of FIG. 5. A large number of suction elements 20 are provided, which form a large number of chambers 24 that are open at the bottom. The chambers 24 are connected via pipelines 60 to a vacuum control device 21, which is illustrated in cross section in FIG. 13. The vacuum control device 21 includes a housing block 61, in which a control cylinder 62 is rotatably mounted. The direction of rotation is indicated by an arrow 63. The control cylinder is rotated by a drive device (not illustrated). A vacuum source 22 is connected axially to the vacuum control device 21, supplying vacuum to the interior of the control cylinder 62. The control cylinder 62 has control openings 64 of selected arcuate length and placements and which, depending on the rotational position, overlie outlets 65 in the housing block 61. Depending on the rotational position of the control cylinder 62, a connection is created between the respective chamber 24 and the vacuum source 22. The openings 24 are placed so that, starting from the trailing edge 10, adhesive action is built up in the transport direction, as explained above. The control cylinder 62 may have venting openings 66, which are connected to the outside atmosphere or even to a compressed-air generator, in order to vent the cylinders 62 or even to apply compressed air to them, in order to accelerate the venting. For simplicity, the precise routing of the compressed air is not reproduced in FIGS. 12 and 13. Finally, in FIG. 12, a piston disk 67 moves within the control cylinder 62 in the directions of the double arrow 68, which makes adaptation to the longitudinal format of the sheet metal panels 3 possible, that is, an appropriate number of chambers 24 are activated.

Figure 14:
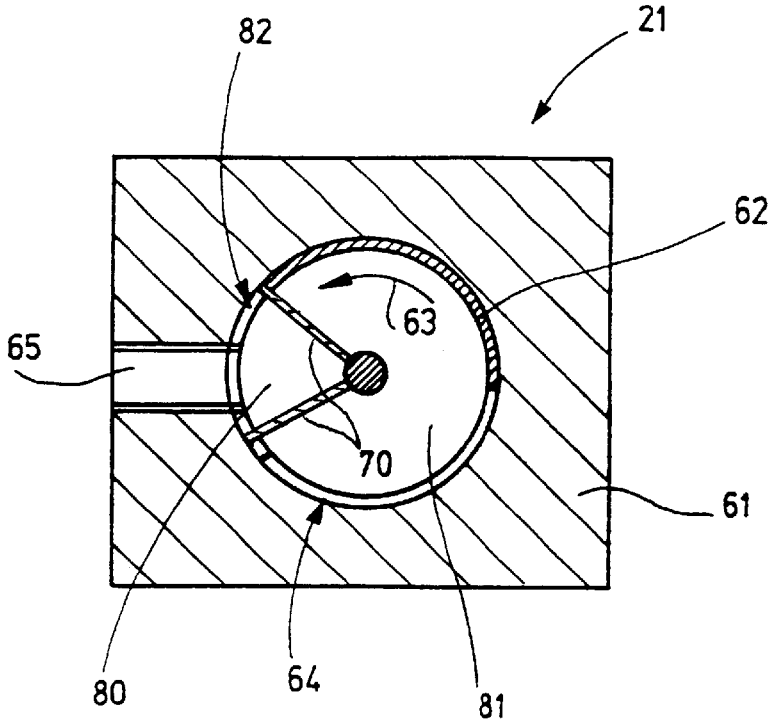
FIG. 14 shows a cross-section through a second such vacuum control device.

The embodiment of the vacuum control device 21 of FIG. 14 corresponds essentially to the exemplary embodiment of FIG. 13, but the control cylinder 62 is divided up along the axial direction by axially extending, radially directed walls 70 into at least two arcuate regions 80, 81, one region carrying vacuum and the other carrying compressed air. Control openings 64 and 82 are assigned to the two regions 80 and 81, so that for each activation of a chamber during one rotation of the control cylinder 62, vacuum is applied and, after a corresponding time delay, compressed air is applied. It is also possible to apply vacuum and/or positive pressure more than once per revolution. Suitable constructional devices may make the control openings 64 and/or 82 variably adjustable in their size, preferably in their circumferential directional length, to allow suitable adjustment of the adhesive action.

Figure 15:
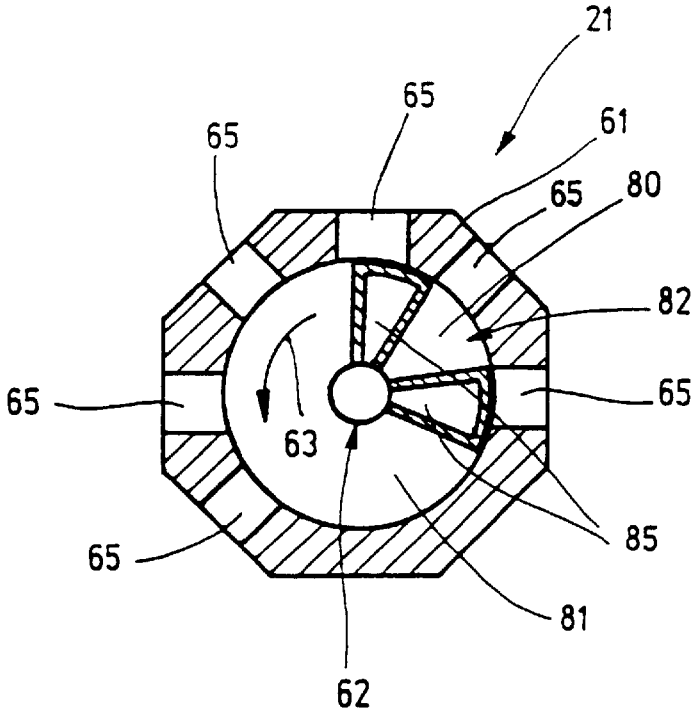
FIG. 15 shows a cross-section through a third such vacuum control device.

FIG. 15 shows an embodiment in which a large number of outlets 65 are provided around the circumferential direction on the housing block 61. The control cylinder 62 has the form of arcuate shape sealing segments 85, which are angularly spaced apart and which close or open the outlets 65 depending on their rotational positions. Different regions 80 and 81 are formed between the sealing segments 85, to which suction air and/or compressed air is applied. This produces a different activating sequence of the chambers 24 in comparison with the embodiment of FIG. 14.

Figure 16:
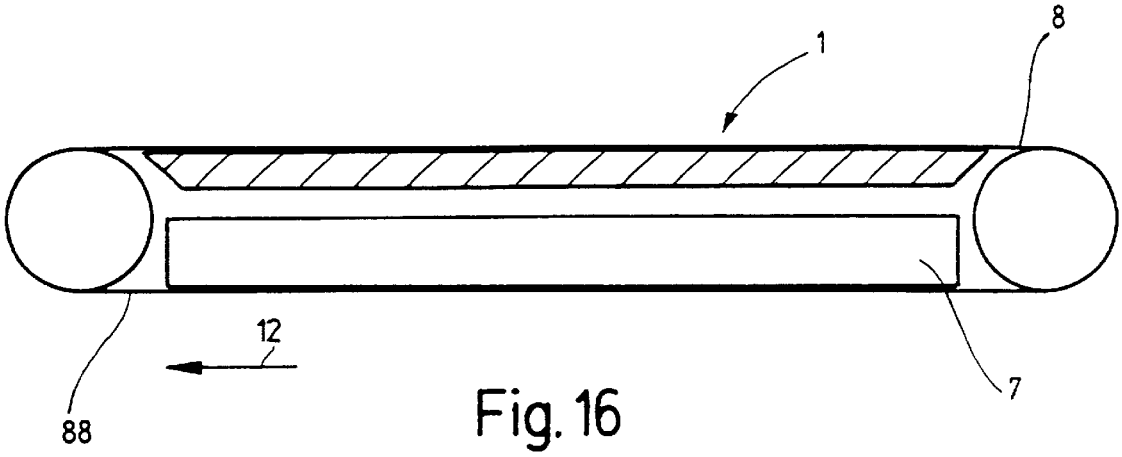
FIG. 16 shows schematically a part of an eighth embodiment of a separating apparatus with adhesion device and transport device.

The embodiment of FIG. 16 combines an adhesion device 7 with a transport device 8. The adhesion device 7 is designed as an adhesion bar and is located within an endless belt run 88. The belt run is permeable to air, so that the adhesive or suction action of the adhesion device 7 can act on the sheet metal panel 3 through the belt run 88. Once the sheet metal panel 3 has been lifted by means of the adhesion device 7, the endless belt run 88 is set in motion by a controllable drive and the belt transports the sheet metal panel 3 in the transport direction 12 to a further-processing location. The adhesion device 7 is one of the above embodiments.

Figure 17:
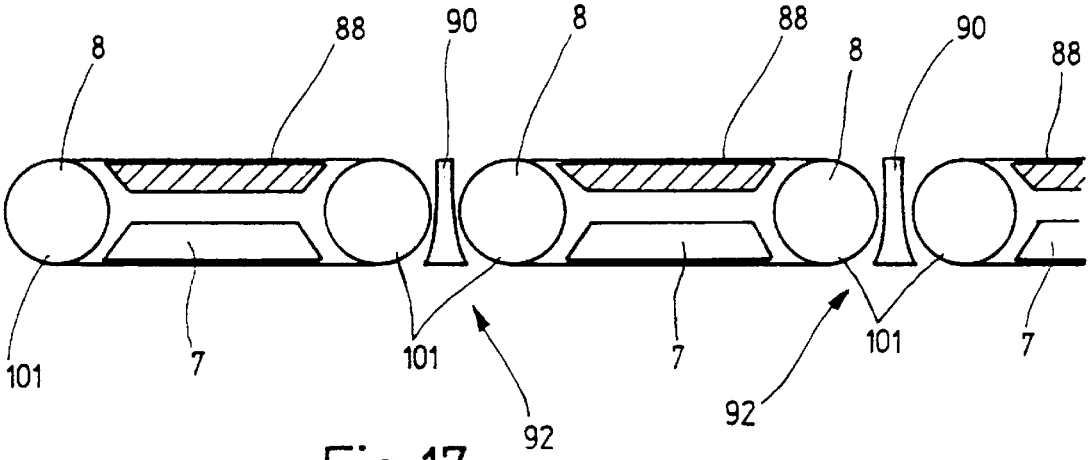
FIG. 17 shows schematically a part of a ninth embodiment of a separating apparatus.

FIG. 17 shows several devices according to the embodiment of FIG. 16 arranged one after another. Suction bars 90 are arranged between each pair of adjacent endless belt runs 88 provided with an adhesion device 7. The bars 90 ensure smooth running of the sheet metal panels 3 in the transition regions 92 between the devices. The turn rollers of the endless belt run 88 are designated by 101.

Figure 18:
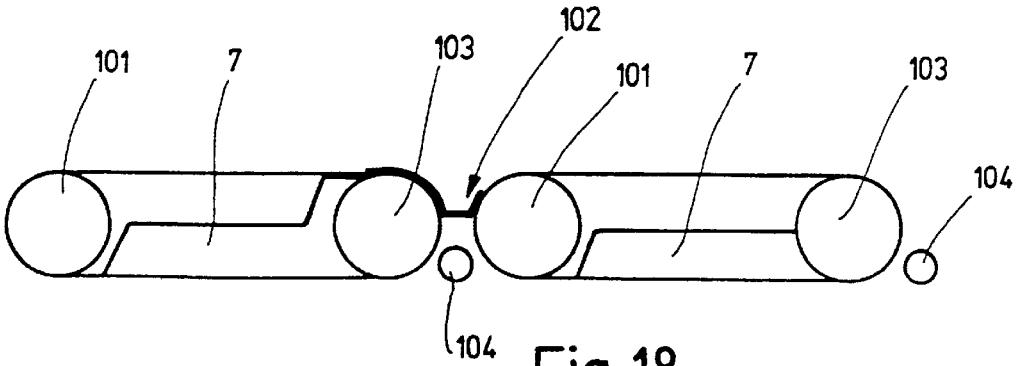
FIG. 18 shows schematically a part of a tenth embodiment of a separating apparatus.

FIG. 18 shows a further embodiment, which corresponds approximately to that of FIG. 17, but some of the turn rollers 103 and the adhesion devices 7 are designed so that there is effective vacuum also in the respective interspace 102, where there is also a guide roll 104 in each case. This vacuum can be achieved by a circumferential and/or turn roller 103 or by means of perforated turn rollers 104, wherein the latter are air-permeable so that the vacuum also acts there.

Figure 19:
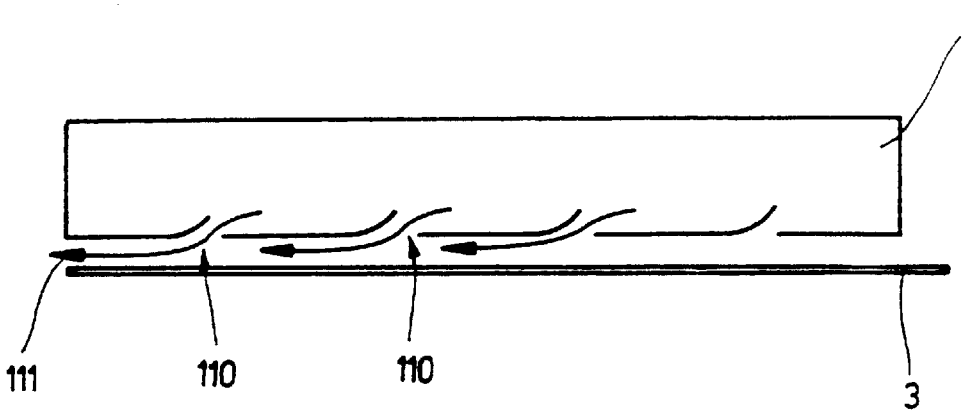
FIG. 19 shows schematically a part of an eleventh embodiment of a separating apparatus.
Figure 20:
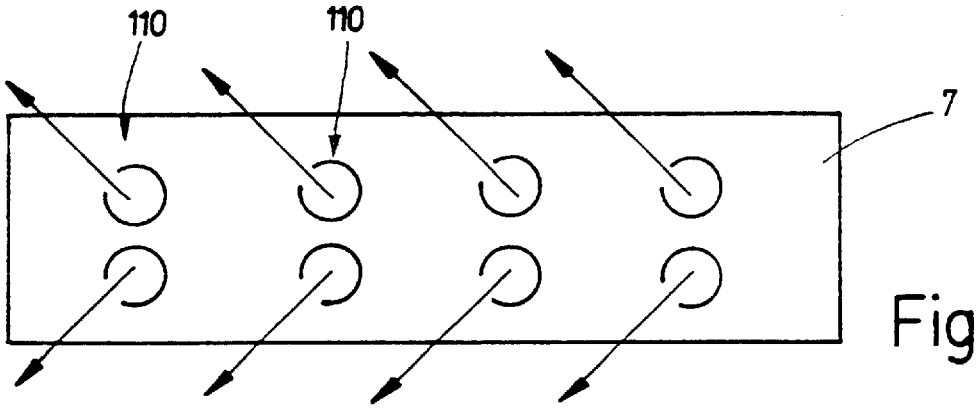
FIG. 20 shows schematically a bottom view of the separating apparatus of FIG. 19.

FIGS. 19 and 20 show an embodiment of an adhesion device 7, designed as a blown air device, which blows air essentially along the surface of the sheet metal panel 3 to be lifted. The underside of the adhesion device has appropriate outlet openings 110, from which blown air 111 emerges. The blown air 111 runs approximately parallel to the surface of a sheet metal panel 3. Given an appropriately large distance between the sheet metal panel 3 and adhesion device 7, a vacuum is produced by the flow velocity of the blown air 111, so that the sheet metal panel 3 is lifted in the direction of the adhesion device 7. If the sheet metal panel 3 approaches the adhesion device 7 too closely, then the sheet metal panel 3 is repelled by the momentum of the air flow. These relationships cause the sheet metal panel 3 to "float" at a uniform distance from the adhesion device so it can be transported easily and without scratching. Transport is preferably performed by endless belt runs with a suction device. By controlling the blown air openings 110 appropriately, adhesive action can be built up continuously and progressively. In this embodiment, it is of particular significance that, when the sheet metal panels 3 are being lifted, no contact with the panel occurs, so that damage like scratching, etc., is avoided.

Figure 21:
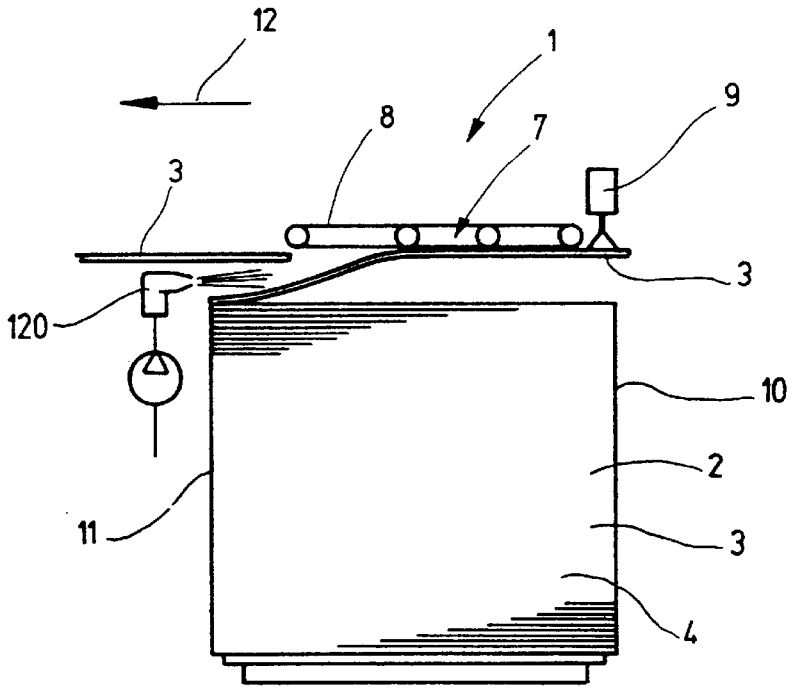
FIG. 21 shows schematically a part of a twelfth embodiment of a separating apparatus.

The embodiment of FIG. 21 shows an apparatus 1 with an air nozzle 120, from which blown air emerges in the region of the leading edge 11 of the sheet metal panels 3 on the stack 4. The air is blown between a sheet metal panel 3 that has already been lifted and is being transported away, and a sheet metal panel 3 that is then being lifted. As a result, the trailing edge of the sheet metal panel 3 being transported away is prevented from contacting the sheet metal panel 3 that is then being lifted. Furthermore, the blown air can be used to compensate for the suction by the adhesion device 7. To this end, the blowing nozzle 120 is arranged to be appropriately movable, i.e., pivotable, or the like, in order to initially compensate for the entire vacuum of the adhesion device 7 and then, in order to lift a sheet metal panel 3, to discontinue this compensation, initially in the region of the trailing edge 10. The discontinuation is progressively carried out in the transport direction 12, so that the vacuum of the adhesion device 7 can be developed there, and the lifting of the sheet metal panel 3 takes place in this way.

Figure 22:
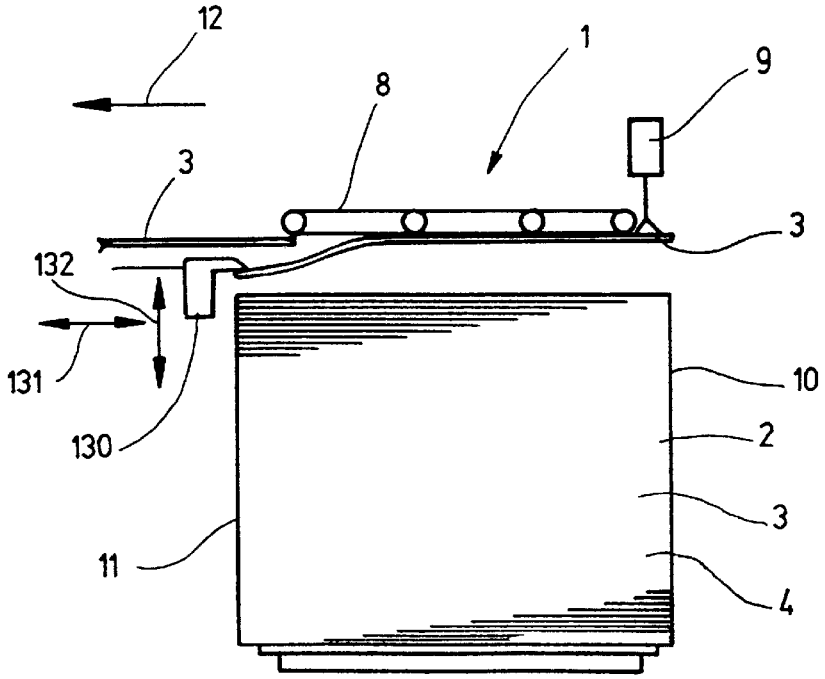
FIG. 22 shows schematically a part of a thirteenth embodiment of a separating apparatus.

FIG. 22 shows an embodiment in which, in addition or as an alternative to the air nozzle 120, a stop 130 is provided, which can be positioned and be movable both in its height (arrow 132) and in the transport direction 12 according to double arrow 131. The stop 130 keeps the sheet metal panel 3, which is then being lifted, away from the trailing edge of the sheet metal panel 3 which has already been transported away, avoiding a collision. The position of the stop 130 is preferably variable, depending on the position of the respective sheet metal panels 3.

Figure 23:
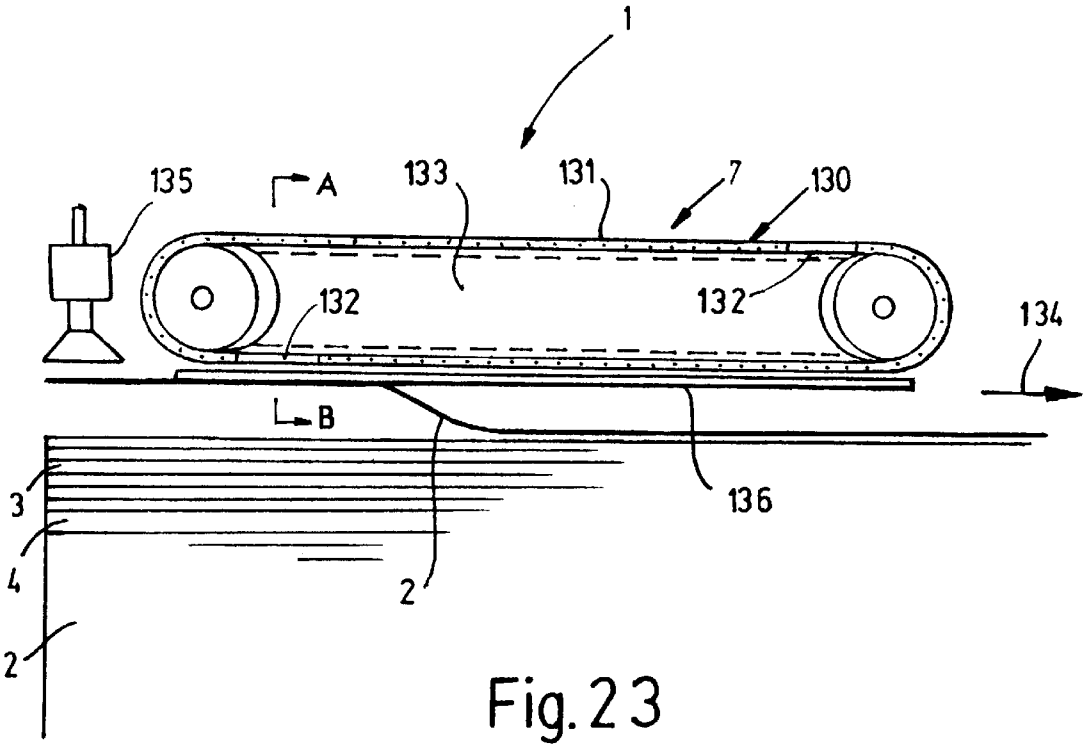
FIG. 23 shows schematically a part of a side view of a fourteenth embodiment of a separating apparatus.

FIG. 23 shows a further embodiment of an apparatus 1, which has an endless circulating belt run 130 as the adhesion device 7. The belt run 130 has an air-impermeable, endlessly circulating band 131, which is provided at rotationally opposite points with a respective suction hole 132. A suction box 133, which is connected to a vacuum source is located inside the belt run. The belt run 130 is located above the stack 4, which is formed from flexible, flat objects 2, which are preferably sheet metal panels 3. Opposite the transport direction (arrow 134), a lifting sucker 135 is located at the end of the belt run 130. The lower region of the belt run 130 is covered by an air-permeable covering 136, which is stationary and is a short distance from the band 131. The band 131, which is a suction band because of the suction holes 132, does not scrape on the covering 136. However, it is also possible to use a band 131 that is as resistant as possible to abrasion, so that contact between the band 131 and the covering 136 is possible without any significant wear.

Figure 24:
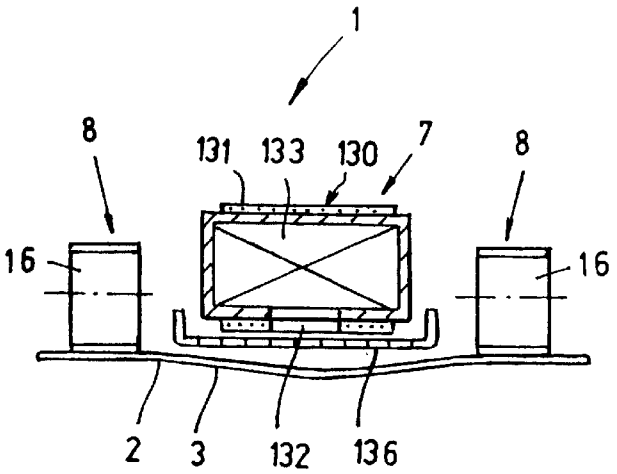
FIG. 24 shows a cross-section through the separating apparatus of FIG. 23 along the line A-B.

In FIG. 24, the transport device 8, which is formed from two suction belt devices 16, is constructed on both sides of the adhesion device 7.

The apparatus according to FIGS. 23 and 24 operates as follows. The lifting sucker 135 lifts the object 2 from the top of the stack 4 at its end remote from the transport device 134. One of the suction holes 132 of the circulating belt run 130 comes into the vicinity of the lifted region of the article 2. On account of the movement which continues in the transport direction 134, the suction hole exerts a suction action that runs over the object 2, so that the object 2 is attracted by suction, progressively and in the manner of a wave, against the underside of the covering 136. The suction belt devices 16 arranged on either side of the adhesion device 7 are in the rest position during lifting of the object 2. However, they both have either a vacuum action or else a magnetic action, so that they hold the object 2 firmly. Once the object 2 has been lifted completely because of the suction action of the suction hole 132, the suction belt devices 16 begin to move and transport the object 2 away in the transport direction 134. This enables the next object 2 to be lifted from the stack 4. This lifting can also partly overlap the previous object 2 which is being transported away. According to FIG. 24, it is possible to transport the object 2 away without any contact with the underside of the covering 136, provided that the object 2 sags slightly downwards because of its flexibility. This sagging occurs because no suction action is exerted on the object 2 by the suction box 133 in the operating state, because that region of the band 131 is not designed with a suction hole 132.

Figure 26:
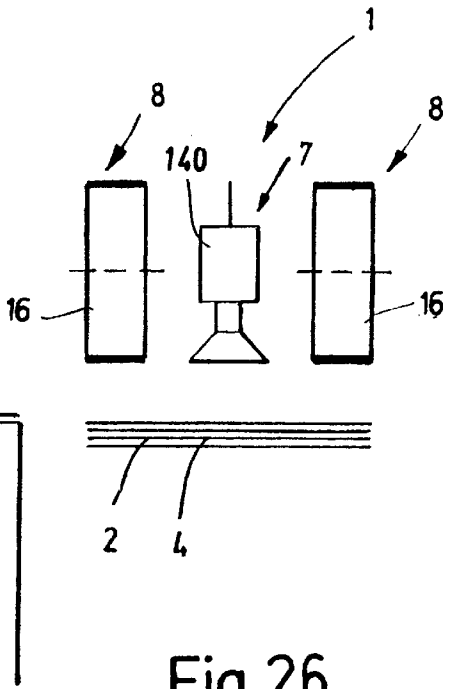
FIG. 26 shows an end view of the separating apparatus of FIG. 25 along the direction of the arrow C in FIG. 25.
Figure 25:
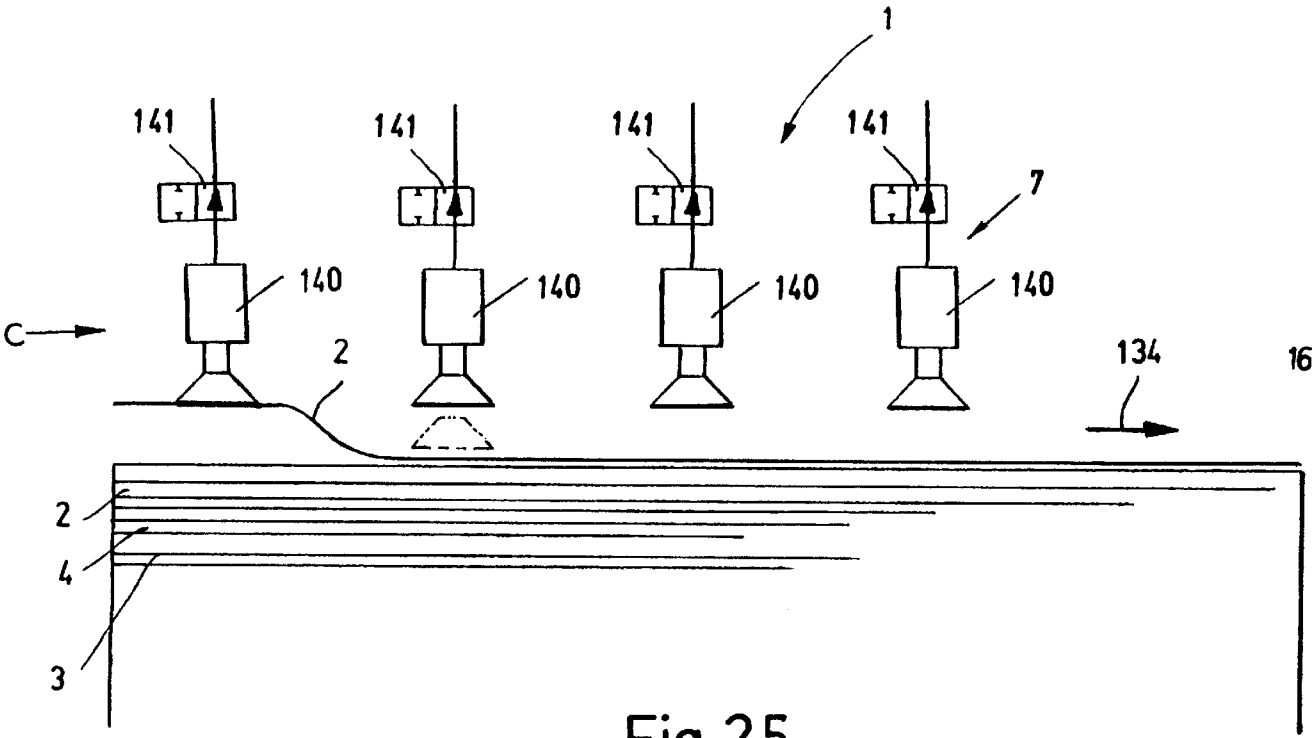
FIG. 25 shows schematically a part of a fifteenth embodiment of a separating apparatus.
Figure 28:
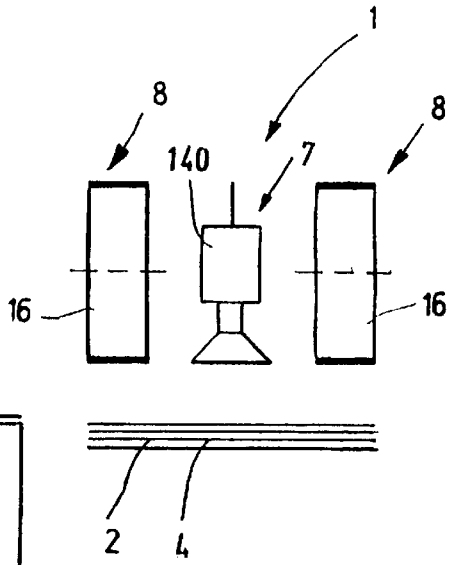
FIG. 28 shows an end view corresponding to FIG. 26 and with flexible, flat objects that have already been lifted not being illustrated in FIGS. 26 and 28.

FIGS. 25 to 28 show a further embodiment of an apparatus 1 for separating flexible, flat objects 2. This has an adhesion device 7 comprised of a plurality of lifting suckers 140, which are spaced apart from and beside one another in the transport direction. They can be activated individually via valves 141 by a control device (not shown). In FIGS. 26 and 28, the transport device 8, which comprises two suction belt devices 16, is located on both sides of the adhesion device 7. The operation is described. First, the lifting sucker 140 located furthest away from the transport direction 134 is lowered, is placed on the top object 2 and lifts the object which is held by the suction action, so that the trailing region of the flat object 2 is lifted. The adjacent lifting sucker 140 is next placed on the flat object 2, and its valve 141 activates the vacuum and the corresponding region of the object 2 is lifted. This progresses with the other lifting suckers 140 in the transport direction 134, so that the entire object 2 is eventually lifted. The article 2 is transferred so as to be held by the suction belt devices 16, which are at rest. The lifting suckers 140, which are stationary, are deactivated by means of the valves 141, and the object 2 is transported away by starting up the drive to the suction belt devices 16.

Figure 27:
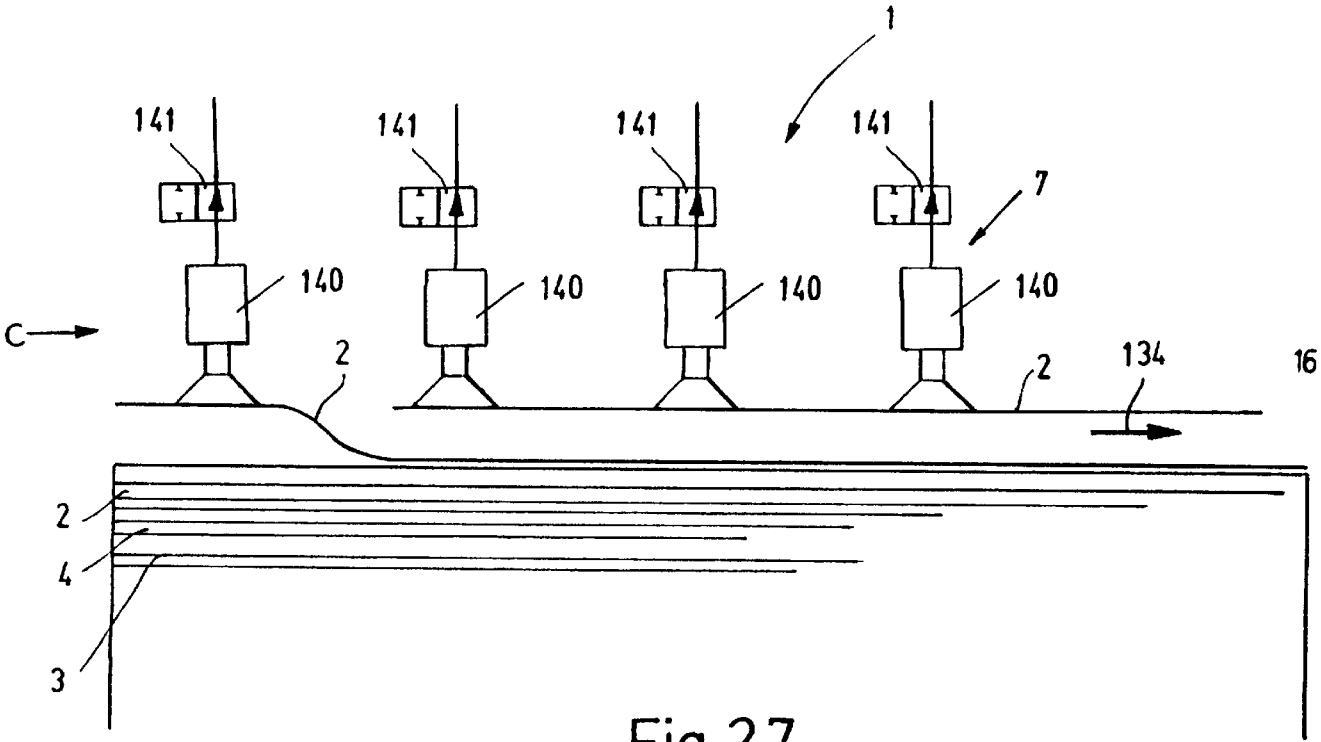
FIG. 27 shows schematically the separating device of FIG. 25 in a different operating state.

FIG. 27 shows that the objects 2 can be transported away in an overlapping fashion, such that an object 2 that is still being transported away is in a position in which it still overlaps the following object 2. In the region of the trailing edge of the object 2 that was lifted first, the following object 2 is already being lifted by the lifting sucker or lifting suckers 140 located there.

In FIG. 23, it is possible to dispense with the lifting suckers 135, provided a sufficiently strong vacuum is exerted on the object 2 by the suction hole 132 so that the object is lifted by the suction action alone. It is also possible to use a sucker 135 which does not move upward or downward and which has adequately strong suction action. The comment as to the upward and downward movement also applies to FIG. 25, so that, instead of being lifting suckers, suckers 140 may be arranged to be stationary, and to not carry out any vertical upward and downward movement.

Figure 29:
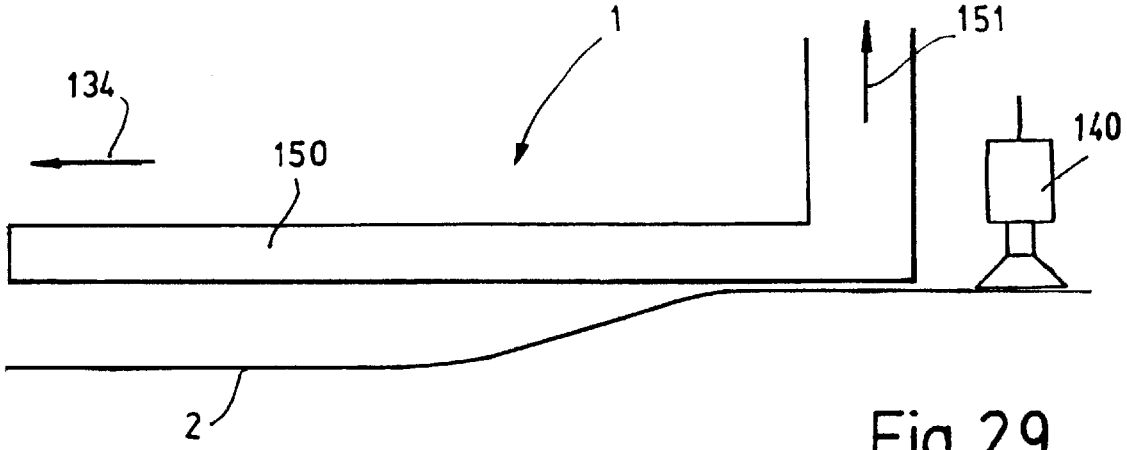
FIG. 29 shows schematically a part of a sixteenth embodiment of a separating apparatus.

FIG. 29 shows a further embodiment of an apparatus 1 with a suction box or suction bar 150 that extends over the length of the object 2. The suction bar 150 applies suction at arrow 154, at the end which is located opposite the transport direction 134. A suction belt device 16 is on either side of the suction bar 150, corresponding to the illustrations of FIGS. 26 and 28, but this is not illustrated in FIG. 29. The following mode of operation results. The end of the object 2 that is located opposite the transport direction 134 is, by a lifting sucker 140, lifted and is attracted by suction against the suction bar 150. The suction bar 150 is open at the bottom over its entire length. In the region in which the flat object 2 rests against the underside of the suction bar 150 or approaches this underside, a vacuum is built up and, accordingly, a suction action is developed. However, the region of the object 2 that has not yet been approached is not yet held by the suction action. In this way, the object 2 is attracted to the suction bar 150 by suction, while passing through a wave-like elastic deformation. Once this has taken place, the suction belt devices (not illustrated), which are located on either side of the suction bar 150, transport the object 2 away.

Figure 30:
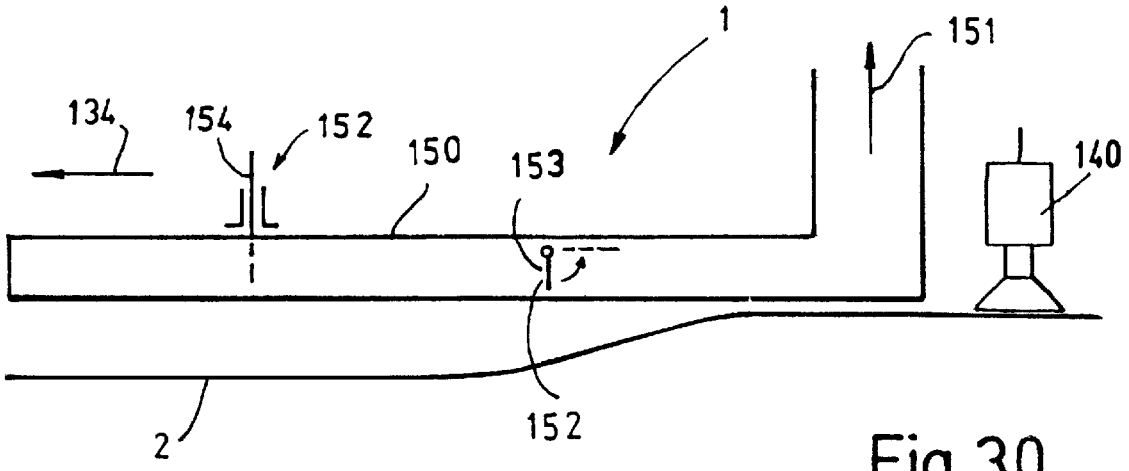
FIG. 30 shows schematically part of a seventeenth embodiment of a separating apparatus.

FIG. 30 shows an apparatus 1 according to FIG. 29, but with control elements for influencing the vacuum. By contrast, in the case of the subject of FIG. 29, virtually automatic control is provided, that is, the closer the corresponding region of the object 2 comes to the suction bar 150, the more powerful is the suction action exerted, Accordingly, a suction attraction effect is formed in a virtually self-controlling manner. By contrast, in the embodiment of FIG. 30, at least one dividing element 152 is arranged inside the suction bar 150, which may be a displaceable folding wall 155, or a linearly movable wall 154, for example. The dividing elements 152 are displaced by a device which is not illustrated. The displacement takes place in such a way that the volume of the suction bar 150 may be reduced, if the folding wall 153 or the sliding wall 154 is displaced in such a way that vacuum (arrow 151) is not applied to all of the volume but to only a part of it. The suction action is correspondingly greater. However, if a corresponding part of the flat object 2 has already been attracted by suction, so that this passes progressively into the region of the corresponding folding wall 150 or the sliding wall 154, then the folding wall 153 is folded into the horizontal position or the sliding wall 154 is withdrawn from the interior of the suction bar 150. As a result, the vacuum is built up in the adjacent region of the suction bar 150 as well. Accordingly, the flexible flat object 2 is progressively attracted by suction. In the embodiments of FIGS. 29 and 30, it is possible for lifting suckers 140, for the initial attraction of the flexible object 2 by suction, to be provided at the end of the flat object 2 that is located opposite the transport direction.

Figure 31:
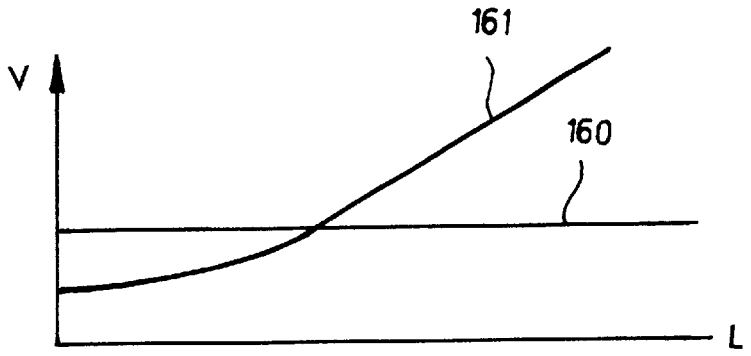
FIG. 31 shows a graph of performance.

The dividing elements 152 control the suction action and also the speed of the progression of the suction action over the longitudinal extent of the object 2. FIG. 31 illustrates this with reference to a graph. The speed V with which the suction wave runs over the surface of the object 2 is indicated on the ordinate. The longitudinal extent L of the object 2 is plotted on the abscissa. The horizontal line 160 has a linear behavior, that is to say the speed of the suction wave is identical everywhere over the longitudinal extent of the object. However, it is also possible to set a progressive behavior by means of appropriate control, as illustrated by the line 161, so that the speed of the wave increases over the extent of the object. It is possible, for example, in this way to achieve adaptation to the lifting work to be provided. A progressive characteristic can also be realized. By means of appropriate control of the suction, for example by the above-mentioned dividing elements 151 or by other measures mentioned previously, it is possible to achieve a variable speed of the suction wave over the path of travel, so that corresponding attraction of the flexible object 2 by suction takes place.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Apparatus for separating flexible flat objects from a stack and transporting the objects in a transport direction establishing a leading edge and a trailing edge of the objects, comprising:

an adhesion device for lifting an object from the top of the stack by adhesive action that attracts the trailing edge of the object upward to the adhesion device and progressively along the object in the transport direction toward the leading edge to lift the object; and a transport device for transporting the lifted object in the transport direction.

2. The apparatus of claim 1, wherein the transport device is shaped and operated so as to transport the lifted object at least approximately horizontally.

3. The apparatus of claim 1, wherein the adhesion device comprises a plurality of suction devices located one after the other along the transport direction and including elements for selectively activating and deactivating the suction elements in a sequence one after the other.

4. The apparatus of claim 1, wherein the adhesion device comprises:

a suction element that extends in the transport direction over the object to be lifted; and a slider at the suction element for moving along the suction element and the slider selectively establishing the portion of the suction element to which suction is applied by moving the slider progressively in the transport direction or in a reverse direction.

5. The apparatus of claim 4, further comprising a suction chamber in the suction element and the slider is positioned at the suction chamber for selectively enlarging or reducing the length of the suction chamber along the transport direction.

6. The apparatus of claim 1, wherein the adhesion device is operable in the transport direction for progressively attracting and adhering the flexible object along the transport direction, and the adhesion device is further displaceable in a direction toward the object for adhering to the object and is displaceable to lift the object.

7. The apparatus of claim 1, wherein the adhesion device includes an element for lifting one region of the object in the stack, the element being movable near to the object and then movable away from the object.

8. The apparatus of claim 1, wherein the adhesion device includes a suction chamber that extends in the transport direction;

at least one dividing wall in the suction chamber for dividing the suction chamber into parts along the length of the suction chamber in the transport direction, the at least one dividing wall being displaceable for selectively connecting or isolating adjacent parts of the suction chamber for moving suction action along the suction chamber.

9. The apparatus of claim 1, wherein the adhesion device comprises a plurality of suction chambers arranged along the adhesion device in the transport direction one after the other and each including a suction opening directed toward the stack of objects; and a vacuum control device connected with each of the suction chambers for selectively activating the suction chambers progressively along the transport direction.

10. The apparatus of claim 1, wherein the transport device comprises a suction belt section which is included in the adhesion device for enabling vacuum and drive for transport of the suction belt to be activated and deactivated.

11. The apparatus of claim 10, wherein there are at least two of the suction belt sections one after the other in the transport direction and a vacuum control device for controlling the vacuum of the suction belt sections to be activated and deactivated either in sequence or simultaneously.

12. The apparatus of claim 11, further comprising additional suction elements located between adjacent suction belt sections and a second vacuum control device for selectively activating and deactivating the additional suction elements.

13. The apparatus of claim 1, wherein the adhesion device comprises a blown air device for blowing air beneath the adhesion device and over the surface of the object to be lifted creating reduced pressure for lifting the object from the stack.

14. The apparatus of claim 1, wherein the adhesion device comprises a vacuum device for vacuum lifting the sheet toward the adhesion device and further comprises a blown air device for blowing air toward the sheet to be lifted and partly counteracting and cancelling the vacuum action of the vacuum device for together controlling the extent to which the sheet is lifted toward the adhesion device.

15. The apparatus of claim 14, further comprising a blown air control device for controlling the blown air direction and intensity and such that a vacuum builds up progressively in the transport direction.

16. The apparatus of claim 1, wherein the transport device comprises a controlled drive belt device.

17. The apparatus of claim 16, wherein the transport device is arranged to the side of the adhesion device along the transport direction, so that the transport device holds the object without the object contacting the adhesion device.

18. The apparatus of claim 16, wherein the controlled drive belt device comprises a suction belt device.

19. The apparatus of claim 1, wherein the adhesion device comprises an endless belt run having a suction band and at least one suction hole through the band through which suction is supplied below the band to the top object in the stack.

20. The apparatus of claim 19, wherein upon movement of the endless belt run, the suction hole is moved over the object for lifting the object.

21. The apparatus of claim 20, wherein the suction hole has length in the transport direction that is shorter than the length in the transport direction of the object to be lifted.

22. The apparatus of claim 21, further comprising a fixed, air permeable covering over the suction band to be between the suction band and the object to be lifted.

23. The apparatus of claim 22, wherein the transport device is arranged to the side of the adhesion device in the transport direction and is beside the suction band, the transport device holding the object and transporting the object without contacting the suction band or the air permeable covering thereover.

24. The apparatus of claim 23, wherein there is a respective one of the transport devices at each side of the suction band with respect to the transport direction.

* * * * *